US010573978B2

(12) United States Patent
Sato et al.

(10) Patent No.: US 10,573,978 B2
(45) Date of Patent: Feb. 25, 2020

(54) CRIMP TERMINAL WITH SEAL MEMBER

(71) Applicant: Yazaki Corporation, Tokyo (JP)

(72) Inventors: Kei Sato, Makinohara (JP); Kazuhide Takahashi, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/420,519

(22) Filed: May 23, 2019

(65) Prior Publication Data

US 2019/0280401 A1 Sep. 12, 2019

Related U.S. Application Data

(63) Continuation of application No. PCT/JP2017/016505, filed on Apr. 26, 2017.

(30) Foreign Application Priority Data

Dec. 27, 2016 (JP) ..... 2016-253773

(51) Int. Cl.
*H01R 4/18* (2006.01)
*H01R 4/62* (2006.01)
*H01R 13/52* (2006.01)

(52) U.S. Cl.
CPC ..... *H01R 4/188* (2013.01); *H01R 4/18* (2013.01); *H01R 4/185* (2013.01); *H01R 4/186* (2013.01); *H01R 4/62* (2013.01); *H01R 13/5216* (2013.01)

(58) Field of Classification Search
None
See application file for complete search history.

(56) References Cited

U.S. PATENT DOCUMENTS

2013/0130566 A1 5/2013 Onuma et al.
2015/0020384 A1 1/2015 Yamamoto
2016/0141768 A1 5/2016 Aoki et al.
2016/0359245 A1* 12/2016 Aoki ..... H01R 4/185
2016/0372841 A1* 12/2016 Sato ..... H01R 4/185
(Continued)

FOREIGN PATENT DOCUMENTS

JP 2012-038453 A 2/2012
JP 2015-065148 A 4/2015
(Continued)

OTHER PUBLICATIONS

International Search Report for PCT/JP2017/016505 dated Aug. 1, 2017 (PCT/ISA/210).

*Primary Examiner* — Tho D Ta
(74) *Attorney, Agent, or Firm* — Sughrue Mion, PLLC

(57) ABSTRACT

Provided is a crimp terminal for alleviating manufacturing while maintaining waterproof property against a contact portion with an aluminum core wire. A barrel portion of a crimp terminal has an inner barrel piece and an outer barrel piece, and a seal member is provided for being stuck across a first region, a second region, and a third region, and after crimping for sealing a space between the inner barrel piece and the outer barrel piece, an opening of the barrel portion formed cylindrical on the terminal portion side, and a space between the covered portion and the barrel portion, and a plurality of recesses is dispersedly provided on an inner surface of the barrel portion so as to partly overlap with the seal member.

9 Claims, 35 Drawing Sheets

(56) References Cited

U.S. PATENT DOCUMENTS

| | | | | |
|---|---|---|---|---|
| 2017/0005417 | A1 | 1/2017 | Aoki et al. | |
| 2017/0179617 | A1* | 6/2017 | Yoshida | H01R 4/185 |
| 2017/0179618 | A1* | 6/2017 | Yoshida | H01R 4/185 |
| 2017/0179619 | A1 | 6/2017 | Nakata et al. | |
| 2017/0179637 | A1* | 6/2017 | Nakata | H01R 4/185 |

FOREIGN PATENT DOCUMENTS

| | | | |
|---|---|---|---|
| JP | 2015-201269 | A | 11/2015 |
| JP | 5940198 | B2 | 6/2016 |
| JP | 2017-111946 | A | 6/2017 |
| WO | 2013151189 | A1 | 10/2013 |

* cited by examiner

CRIMP TERMINAL WITH SEAL MEMBER

BACKGROUND OF THE INVENTION

Field of the Invention

The present invention relates to a crimp terminal to be crimped and connected to a covered electric wire having an aluminum core wire.

Description of the Related Art

In recent years, a covered electric wire having an aluminum core wire has been used for a wire harness in place of a covered electric wire having a copper core wire. At this time, for example, some crimp terminals such as connector terminals are made of a copper alloy or the like, and a surface thereof is subjected to tin plating or gold plating. When such crimp terminal as this type is crimped to an end portion of the covered electric wire where the aluminum core wire is exposed, contact between dissimilar metals occurs between the aluminum core wire and the crimping barrel portion of the crimp terminal. If moisture adheres to such a contact portion, there is a possibility that the aluminum core made of aluminum, which is a base metal, is corroded due to so-called dissimilar metal corrosion.

Therefore, there has been proposed a crimp terminal surrounded by a seal member around the contact portion between the barrel portion and the aluminum core wire (see, for example, Patent Document 1). According to such type of crimp terminal, moisture can be prevented from entering the contact portion of dissimilar metals, and generation of dissimilar metal corrosion as described above can be avoided.

FIG. 49 is a view showing an example of a conventional crimp terminal surrounding the contact portion between the barrel portion and the aluminum core wire with a seal member.

The crimp terminal 7 shown in FIG. 49 is the one in which a barrel portion 71 and a terminal portion 72 made of a metal plate such as a copper alloy by sheet metal working and subjected to tin plating or gold plating on the surface are arranged in a predetermined axial direction D71. The barrel portion 71 is a portion that is wounded around and crimped to an end portion W7*a* of the covered electric wire W7 having the aluminum core wire W71, around which the aluminum core wire W71 is exposed. The terminal section 72 is a female terminal to be connected to a pin terminal (not shown) that is a connection object.

The barrel portion 71 has a structure in which a metal plate is bent so that the cross section that intersects with the axial direction D71 is substantially U-shaped. After the end portion W7*a* of the covered electric wire W7 is placed on an inner surface 711 of the barrel portion 71, the barrel portion 71 is wound around and crimped to the end portion W7*a*. A part of an inner surface 711 of the barrel portion 71 becomes a contact portion 711*a* with the aluminum core wire W71 at the end portion W7*a*.

In the contact portion 711*a*, a serration 74 is formed in which a plurality of rows of grooves extending in an intersecting direction D72 crossing the axial direction D71 in the plan view with respect to the contact portion 711*a* is arranged in the axial direction D71. When the barrel portion 71 is wound around and crimped to the end portion W7*a*, an edge of each groove forming the serration 74 bites into the aluminum core wire W71, so that satisfactory conduction between the covered electric wire W 7 and the crimp terminal 7 can be obtained.

A seal member 73 is provided so as to surround the contact portion 711*a*. When the barrel portion 71 is wound around and crimped to the end portion W7*a*, the seal member 73 seals each space around the contact portion 711*a* and prevents moisture from entering.

PRIOR ART DOCUMENT

Patent Document 1: Japanese Patent No. 5940198

SUMMARY OF THE INVENTION

However, with the conventional crimp terminal as shown by way of example in FIG. 49, since it is just a small size for attachment to a covered electric wire, and an installation range of the seal member is narrow, manufacturing is often accompanied by difficulties.

It is therefore an object of the present invention to provide a crimp terminal in which the difficulty in manufacturing is alleviated while ensuring waterproofness against a contact portion with an aluminum core wire in view of the above problem.

In order to solve the above-mentioned problems, a crimp terminal includes a barrel portion windable around and crimpable to an end portion of a covered electric wire having an aluminum core wire, the aluminum core wire being exposed at the end portion, a terminal portion connectable to a connection object; the barrel portion and the terminal portion being arranged in a predetermined axial direction, and the barrel portion including a bottom plate portion extending in the axial direction on which the end portion of the covered electric wire is placed, and an inner barrel piece and an outer barrel piece extending from the bottom plate portion on both sides in a intersecting direction intersecting the axial direction in plan view with respect to the bottom plate portion, and at the time of crimping the barrel portion being wound around the end portion with the inner barrel piece placed inside, and a seal member provided across a first region traversing the outer barrel piece in the axial direction, a second region traversing an inner surface of the barrel portion in the intersecting direction at a position closer to the terminal portion than the aluminum core wire, and a third region traversing the inner surface in the intersecting direction so as to intersect a covered portion of the end portion, and after crimping the seal member sealing a space between the inner barrel piece and the outer barrel piece, an opening of the barrel part formed cylindrical on the terminal portion side, and a space between the covered portion and the barrel portion, wherein a plurality of recesses is dispersedly provided on the inner surface of the barrel portion so as to partly overlap with the seal member.

In the crimp terminal of the present invention, by crimping, each edge of the recesses provided on the inner surface of the barrel portion bites into the aluminum core wire, whereby good conduction between the covered electric wire and the crimp terminal can be obtained. The plurality of recesses provided on the inner surface of the barrel portion partially overlaps the seal member for securing waterproofness against the contact portion with the aluminum core wire. Therefore, the recess at the position overlapping with the seal member can be used as a mark when the seal member is provided on the inner surface of the barrel portion, and it is possible to alleviate the difficulty in manufacturing at this point. In addition, the recesses overlapping with the seal member suppress a movement of the seal member due to a pressure applied at the time of crimping, and also contribute to securing the waterproofness at a higher level. As described above, according to the crimp terminal of the present invention, a part of the recesses provided for good conduction between the covered electric wire and the crimp terminal is used while securing waterproofness against the contact portion with the aluminum core wire, allowing for alleviating difficulties in manufacturing.

Here, in the crimp terminal of the present invention, it is preferable that the plurality of recesses is dispersed substantially over an entire region including the first region, the second region, and the third region on the inner surface of the barrel portion.

According to this preferred crimp terminal, the inner surface shape of the barrel portion is simplified such that the plurality of recesses is dispersed over substantially the entire area, so that it is possible to alleviate difficulty in manufacturing. In addition, when the seal member is provided, providing along the outer periphery of the barrel portion allows the seal member and the recess to overlap even if the seal member is somewhat inclined or the like. That is, since a high positional accuracy is unnecessary when providing the seal member, it is possible to further alleviate difficulties in manufacturing even in this respect.

Here, in the crimp terminal of the present invention, the groove portion is formed on the inner surface of the barrel portion so as to overlap with the seal member in the first region, the second region, and the third region, and it is taken as a reference example that the plurality of recess is provided so as to partly overlap the seal member while avoiding the groove portions.

According to this crimp terminal of the reference example, the movement of the seal member due to the pressure applied at the time of crimping is also suppressed by the groove portion overlapping with the seal member. Therefore, according to this crimp terminal of the reference example, it is possible to alleviate difficulties in manufacturing while securing waterproofness at a higher level. In addition, the groove portion overlapping the seal member can also be used as a marker for providing the seal member on the inner surface of the barrel portion, allowing for further alleviating manufacturing difficulty in this point.

According to the present invention, it is possible to obtain a crimp terminal in which difficulty in manufacturing is alleviated while ensuring waterproofness against the contact portion with the aluminum core wire.

DETAILED DESCRIPTION OF THE PREFERRED EMBODIMENTS

Hereinafter, various embodiments of the present invention will be described. First, a reference example will appropriately be explained with modifications.

Figure 1:
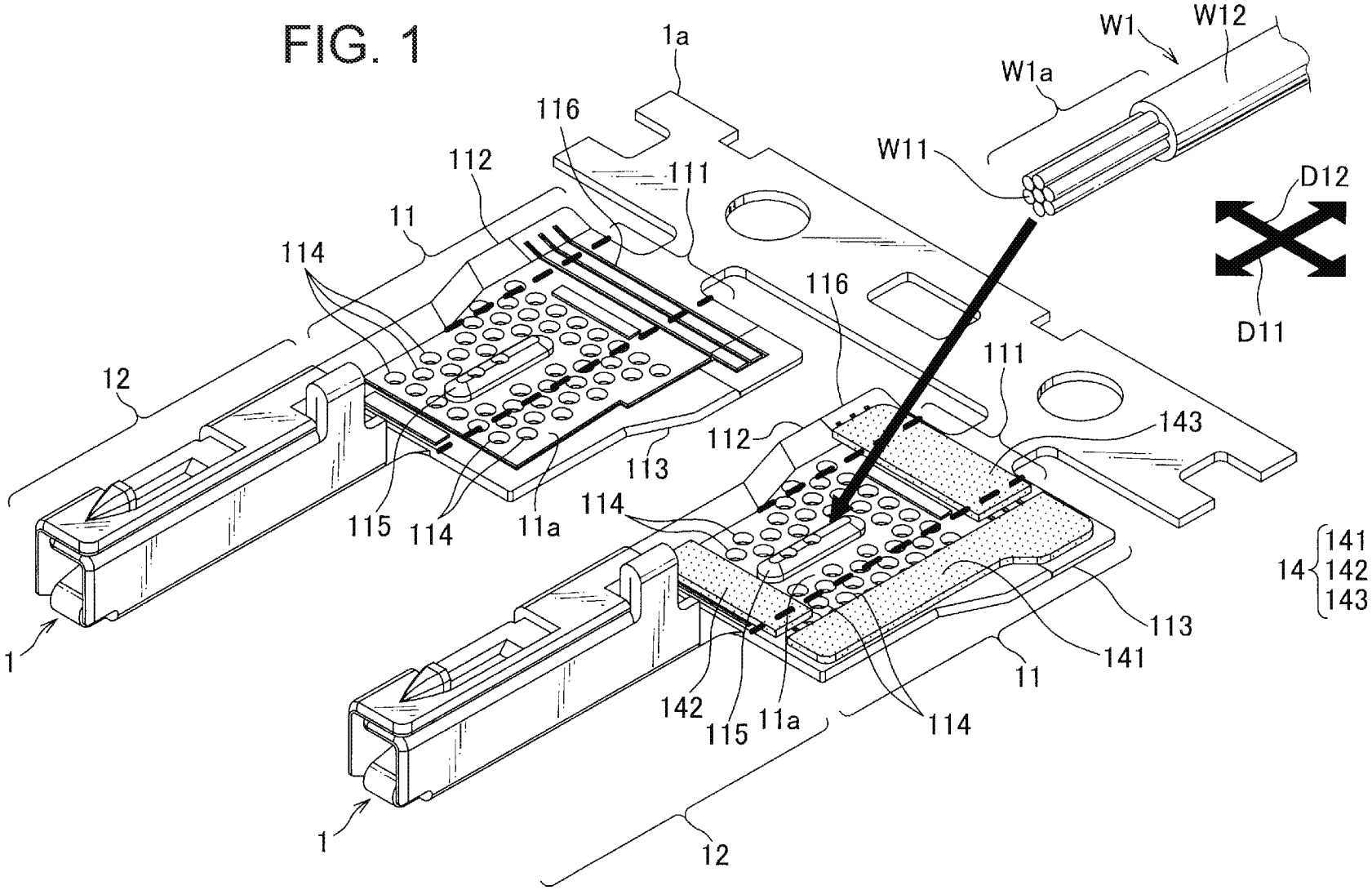
FIG. 1 is a view for explaining a crimp terminal according to a reference example of the present invention.

FIG. 1 is a view for explaining a crimp terminal according to a reference example of the present invention.

The crimp terminal 1 according to the reference example is crimped to an end portion W1*a* of a covered electric wire W1 where an aluminum core wire W11 is exposed. The crimp terminal 1 includes a barrel portion 11, a terminal portion 12, and a seal member 14. Although two crimp terminals 1 are shown in FIG. 1, one crimp terminal 1 is shown with the seal member 14 removed so that the inner surface shape of the barrel portion 11 can be visually observed.

The barrel portion 11 and the terminal part 12 are made by punching and sheet metal working from a metal plate such as a copper alloy, and the surface is subjected to tin plating or gold plating. The barrel portion 11 and the terminal portion 12 are arranged in a predetermined axial direction D11. Here, in the reference example, the barrel portion 11 and the terminal portion 12 are collectively formed in a state in which the plurality of crimp terminals 1 is connected by a strip-like connecting piece 1*a*. The barrel portion 11 is a plate-like portion wound around and crimped to the end portion W1*a* of the covered electric wire W1 so as to wrap around the aluminum core wire W11 and the covering portion W12 in the circumferential direction. The terminal portion 12 is a square tubular female terminal connected to a pin terminal (not shown) to be connected.

The barrel portion 11 has a bottom plate portion 111, an inner barrel piece 112, and an outer barrel piece 113. The bottom plate portion 111 is a portion extending in the above-mentioned axial direction D11. The inner barrel piece 112 and the outer barrel piece 113 are parts extending from the bottom plate part 111 on both sides in an intersecting direction D12 intersecting the axial direction D11 in plan view with respect to the bottom plate part 111. When crimping the end portion W1*a* of the covered electric wire W1, the barrel portion 11 is wound around the end portion W1*a* with the inner barrel piece 112 inside and the outer barrel piece 113 outward as described later.

Here, a plurality of recesses 114 is dispersedly provided on the inner surface 11*a* of the barrel portion 11. Each recess 114 is formed in a circular shape in plan view with respect to the inner surface 11*a* of the barrel portion 11. A projection 115 is formed on the bottom plate portion 111 of the barrel portion 11 by press working from the outer surface side at a position where the aluminum core wire W11 at the end portion W1*a* of the covered electric wire W1 is placed. A part of the plurality of recesses 114 is also formed on the projection 115.

A seal member 14 formed of an adhesive gel sheet is affixed to the inner surface 11*a* of the barrel portion 11 so as to surround the plurality of recesses 114 from three sides in a plan view. The seal member 14 is affixed as follows. It is noted that examples of the adhesive gel sheet include, for example, those using acrylic pressure-sensitive adhesives, but are not limited thereto.

Figure 2:
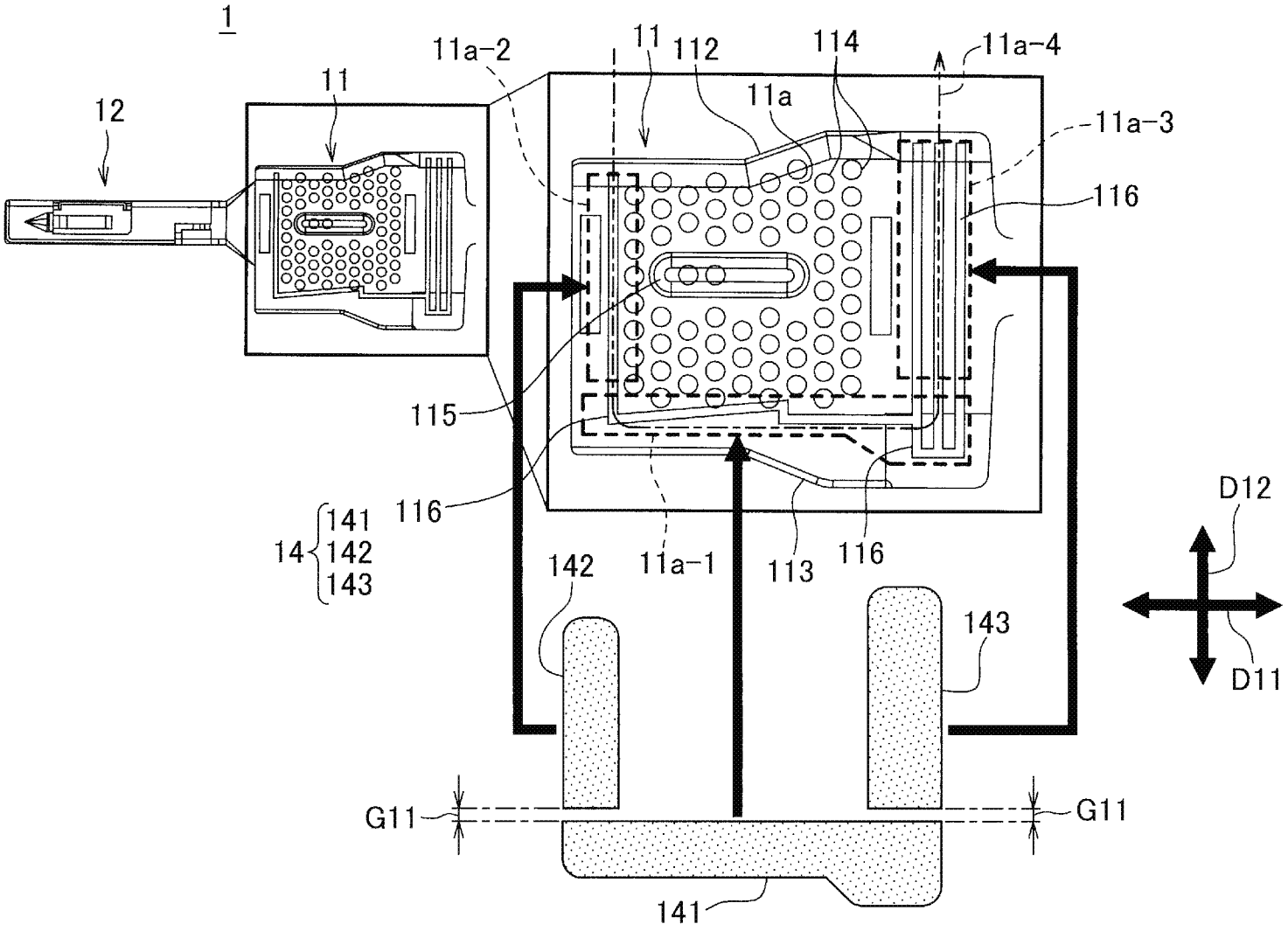
FIG. 2 is a schematic view showing how a seal member shown in FIG. 1 is attached to an inner surface of a barrel portion.

FIG. 2 is a schematic view showing how the seal member shown in FIG. 1 is attached to the inner surface of the barrel portion.

The seal member 14 is formed of the adhesive gel sheet and is arranged over three regions of a first region 11*a*-1, a second region 11*a*-2, and a third region 11*a*-3 on the inner surface 11*a* of the barrel portion 11. The first region 11*a*-1 is a region that transverses the outer barrel piece 113 in the axial direction D11. The second region 11*a*-2 is an area that traverses the inner surface 11*a* in the intersecting direction D12 closer to the terminal portion 12 than the aluminum core wire W11 when the end portion W1*a* is placed. The third region 11*a*-3 is an area that traverses the inner surface 11*a* in the intersecting direction D12 so as to intersect the covering portion W12 of the end portion W1*a*.

As shown in FIGS. 1 and 2, in the reference example, the seal member 14 is composed of three portions, a first seal portion 141, a second seal portion 142, and a third seal portion 143. The first seal portion 141 is a portion extending in a band shape in the axial direction D11 in the first region 11*a*-1. The second seal portion 142 is a portion extending in a band shape in the intersecting direction D12 in the second region 11*a*-2. The third seal portion 143 is a portion extending in a band shape in the intersection direction D12 in the third region 11*a*-3.

In the reference example, the seal member 14 is attached in a state of being divided in the middle of a path 11*a*-4 extending from the second region 11*a*-2 through the first region 11*a*-1 to the third region 11*a*-3. Specifically, the seal member 14 is attached in a state where both the second seal portion 142 and the third seal portion 143 are separated from the first seal portion 141. Both the second seal portion 142 and the third seal portion 143 are attached in a state where the second seal portion 142 and the third seal portion 143 are separated from the first seal portion 141 across the path 11*a*-4 in the axial direction D11. Sight spaces G11 open between the second seal portion 142 and the third seal portion 143, and the first seal portion 141.

Further, in the reference example, in the inner surface 11*a* of the barrel portion 11, a groove portion 116 is formed in the first region 11*a*-1, the second region 11*a*-2, and the third region 11*a*-3 so as to overlap with the seal member 14. In the first region 11*a*-1, one groove extends in the axial direction D11 while bending in a sawtooth shape in the middle. In the second area 11*a*-2 one groove extends linearly in the intersecting direction D12, in the third area 11*a*-3 three grooves extend linearly in the intersecting direction D12, and are joined together on the side of the first area 11*a*-1. Then, the plurality of recesses 114 is provided avoiding the groove portion 116.

The first seal portion 141, the second seal portion 142, and the third seal portion 143 are formed so that they respectively overlap the groove portions 116 of the first region 11*a*-1, the second region 11*a*-2, and the third region 11*a*-3. Here, the plurality of recesses 114 is provided so as to partially overlap with the seal member 14. Specifically, as shown in FIG. 2, the recesses 114 on the edge side of the outermost barrel piece 113 partially overlaps with the first region 11*a*-1, the recesses 114 closest to the terminal portion 12 is provided so as to partially overlap with the second region 11*a*-2. As a result, the first seal portion 141 applied to the first region 11*a*-1 and the second seal portion 142 adhered to the second region 11*a*-2 and the part of the recesses 114 partially overlap.

The crimp terminal 1 described above is manufactured by the following terminal manufacturing method.

In this terminal manufacturing method, first, a sheet metal working step of forming a structure before attachment of the seal member 14 is performed. In the sheet metal working step, the barrel portion 11 is formed together with the terminal portion 12 from a metal plate. As described above, in the reference example, in the sheet metal working process, the barrel portion 11 and the terminal portion 12 are collectively formed in a state in which a plurality of crimp terminals 1 is connected with a strip-like connecting piece 1*a*. In this sheet metal working step, the plurality of recesses 114, the projection 115, and the grooves 116 on the inner surface 11*a* of the barrel portion 11 are formed.

Subsequently, a seal member sticking operation is carried out for forming the seal member 14 with an adhesive gel sheet, and for sticking the seal member 14 over the first area 11*a*-1, the second area 11*a*-2, and the third area 11*a*-3. In the step of sticking the seal member 14 is an operation of sticking the seal member 14 in a state where the middle of the path 11*a*-4 from the second region 11*a*-2 to the third region 11*a*-3 via the first region 11*a*-1 is divided. That is, the first seal portion 141, the second seal portion 142, and the third seal portion 143 are individually attached to the inner surface 11*a* of the barrel portion 11.

In addition, in the seal member sticking step, the first seal portion 141, the second seal portion 142, and the third seal portion 143 are removed by punching from the adhesive gel sheet and attached to the inner surface 11*a* of the barrel portion 11. By pushing the adhesive gel sheet to the adhering portion while punching out the adhesive gel sheet toward each of the sticking points on the inner surface 11*a* of the barrel portion 11 with die cutting cutter of each seal portion, the die cutting and sticking are performed substantially at the same time.

The crimp terminal 1 manufactured in this manner is crimped to the end portion W1*a* of the covered electric wire W1 as follows.

Figure 3:
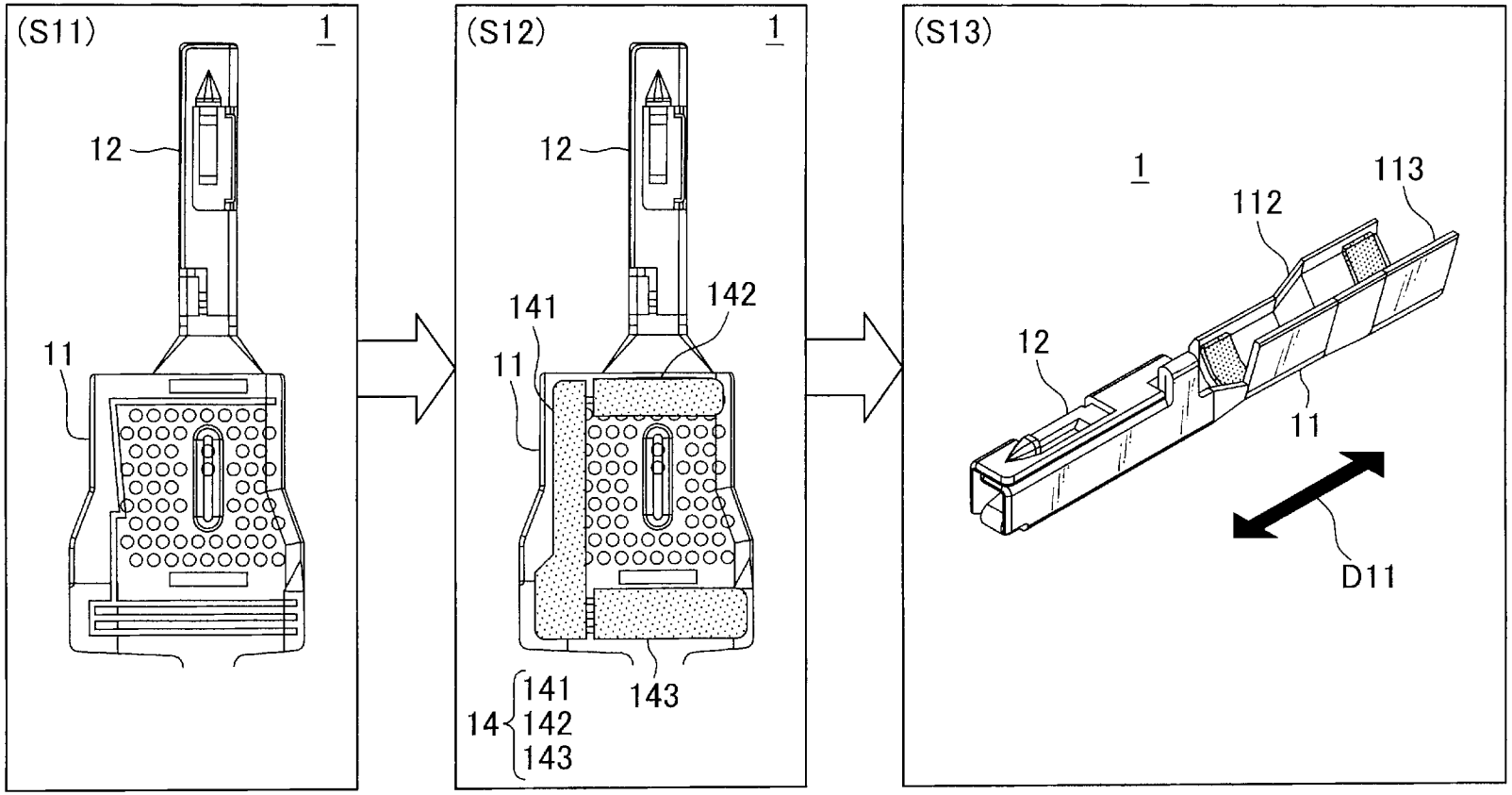
FIG. 3 is a view showing a procedure until preparations are made for crimping the crimp terminal shown in FIGS. 1 and 2 to the end portion of the covered electric wire.
Figure 4:
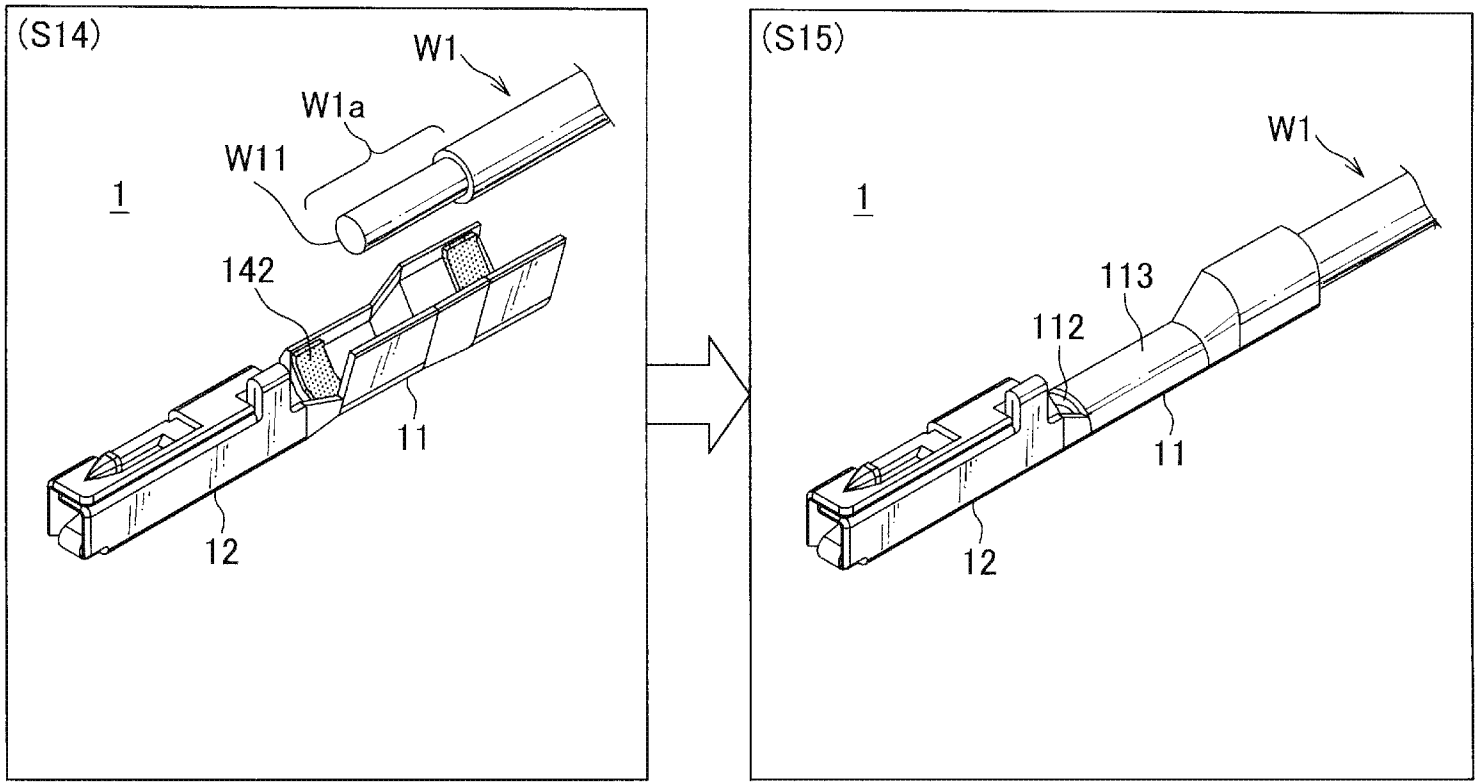
FIG. 4 is a view showing a procedure until the crimp terminal is crimped to the end portion of the covered electric wire following the procedure shown in FIG. 3.

FIG. 3 is a view showing a procedure until preparation is completed for crimping the crimp terminal shown in FIGS. 1 and 2 to the end portion of the covered electric wire, and FIG. 4 is a view showing a procedure until the crimp terminal is crimped to the end portion of the covered electric wire following the procedure of FIG.

FIG. 3 also shows a sheet metal working step (S11) and a seal member sticking step (S12) in the terminal manufacturing method described above. In the sheet metal working step (S11), the barrel portion 11 and the terminal part 12 are formed, and in the seal member sticking step (S12), the first sealing part 141, the second sealing part 142 and the third sealing part 143 that form the seal member 14 is affixed.

When crimping the end portion W1*a* of the covered electric wire W1, first, the crimp terminal 1 to be crimped is separated from the joining piece 1*a* shown in FIG. 1. For the barrel portion 11, bending deformation is performed (S13) as preparation for placing the end portion W1*a* of the covered electric wire W1. This bending deformation is performed such that the inner barrel piece 112 and the outer barrel piece 113 are brought close to each other so that the cross section intersecting with the axial direction D11 is substantially U-shaped.

Subsequently, the end portion W1*a* of the covered electric wire W1 is placed on the barrel portion 11 after the bending deformation (S14). At this time, the end portion W1*a* is placed so that the tip of the aluminum core wire W11 does not overlap with the second seal portion 142. It is noted that overlapping of the tip of the aluminum core wire W11 and the second seal portion 142 is permitted to some extent. Subsequently, the barrel portion 11 is wound around the end part W1*a* so that the outer barrel part 113 is overlapped with the inner barrel piece 112 facing inward (S15).

By such crimping, the seal member 14 seals the various portions of the crimp terminal 1 as follows.

Figure 5:
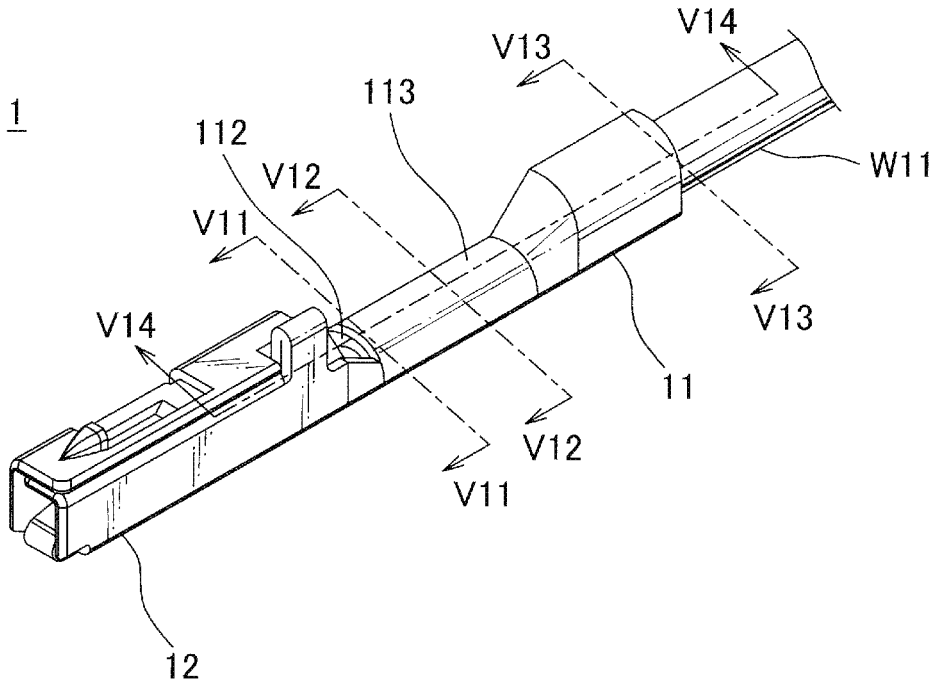
FIG. 5 is a view showing the crimp terminal after crimping also shown in FIG. 4.
Figure 6:
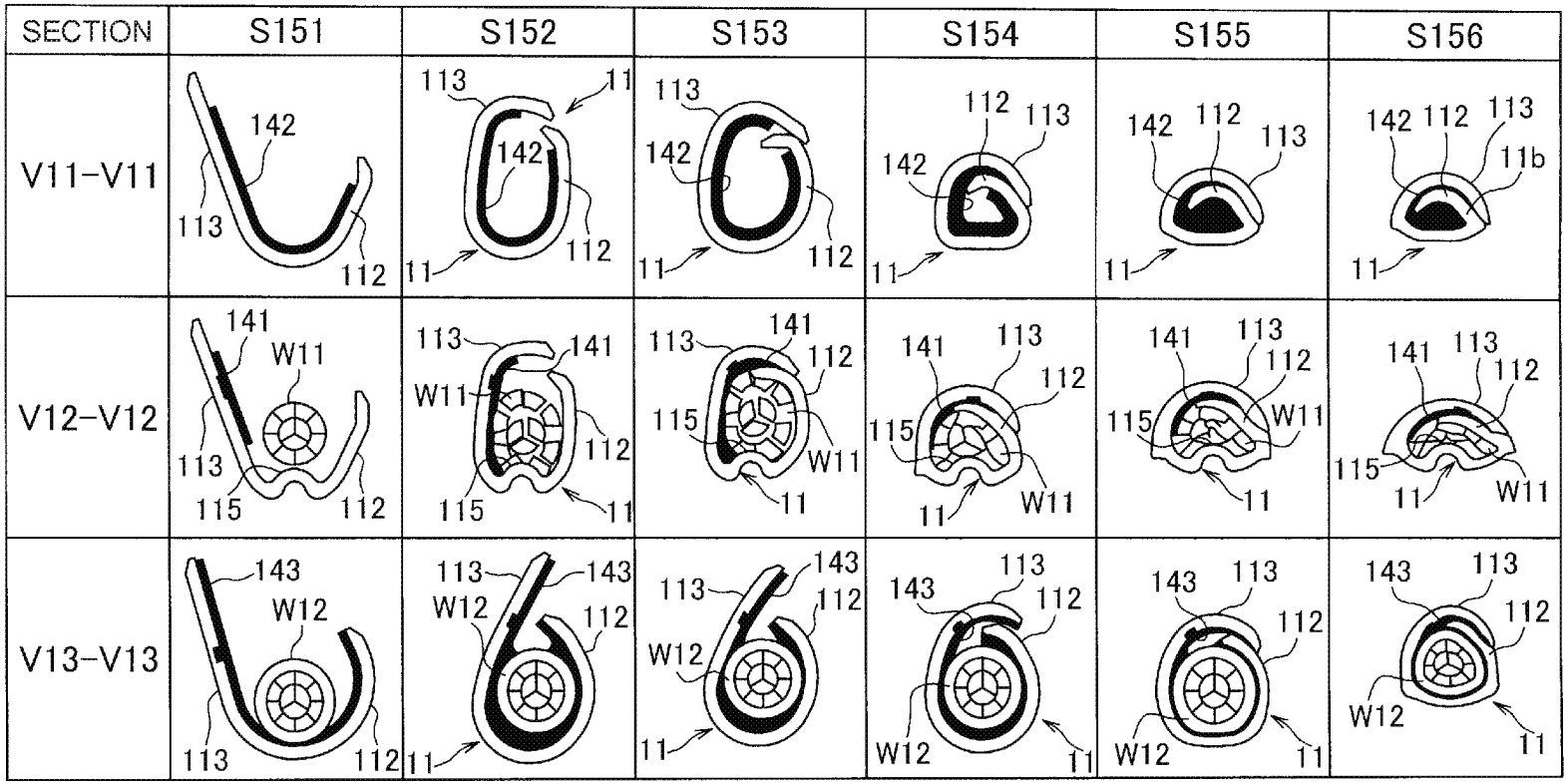
FIG. 6 is a view showing a change during a crimping operation in a cross section taken along line V11-V11, a cross section taken along line V12-V12, and a cross section taken along line V13-V13 in FIG. 5.

FIG. 5 is a view showing the crimp terminal after crimping also shown in FIG. 4. FIG. 6 is a view showing a change during the crimping operation in the cross section taken along the line V11-V11, the line V12-V12, and the cross section taken along the line V13-V13 in FIG. 5.

In the first step (S151) of the crimping operation, bending of the inner barrel piece 112 and the outer barrel piece 113 is started so as to be wound around the aluminum core wire W11 on the projection 115 and the cover part W12 in the vicinity thereof. At this time, the first seal portion 141 is in contact with the aluminum core wire W11, the third seal portion 143 is in contact with the covering portion W12, and the second seal portion 142 is in contact with almost none. In the second step (S152) and the third step (S153) in which the winding is slightly advanced, the barrel portion 11 has a tubular shape. Then, the first seal portion 141 is sandwiched between the inner barrel piece 112 and the outer barrel piece 113, and the third seal part 143 is extended in a state sandwiched between the covering portion W12 and the barrel portion 11.

In the fourth step (S154), the fifth step (S155), and the sixth step (S156) where pressure is applied to the aluminum core wire W11 etc., the edges of the plurality of recesses 114 bite into the aluminum core wire W11. At this time, the strands of the aluminum core wire W11 are spread by the protrusions 115 located under the aluminum core wire W11, and the number of contacts between the barrel portion 11 and these strands increases. At the same time, the extension of the seal member 14 also proceeds.

Here, as described above, in the reference example, slight spaces G11 open between the second seal portion 142 and the third seal portion 143, and the first seal portion 141. These spaces G11 are blocked by extension of the seal member 14 during crimping.

Figure 7:
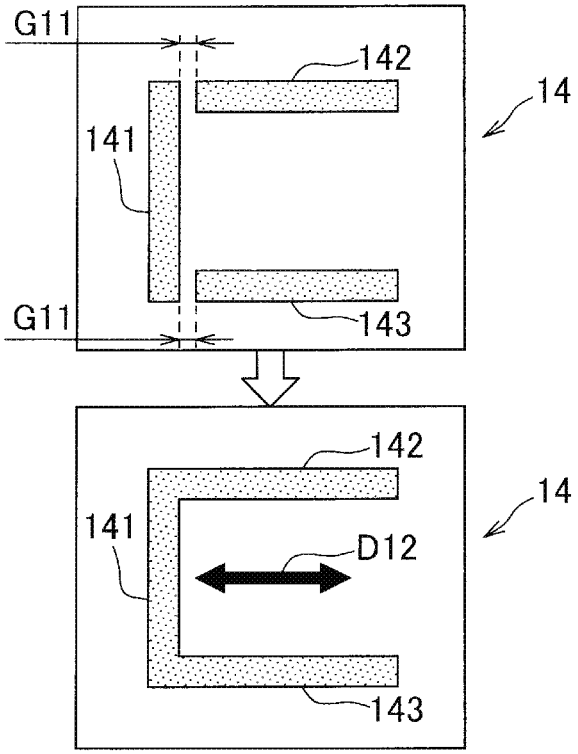
FIG. 7 is a schematic view showing how spaces between the second seal portion and the third seal portion shown in FIG. 2, and the first seal portion are blocked by extension of the seal member at the time of crimping.

FIG. 7 is a schematic view showing how the spaces between the second seal portion and the third seal portion, and the first seal portion shown in FIG. 2 are blocked by extension of the seal member at the time of crimping.

As shown in FIG. 7, at the time of crimping, the second seal portion 142 and the third seal portion 143 are extended in the intersecting direction D12 which coincides with the length direction thereof. Due to this extension, the second seal portion 142 and the third seal portion 143 are connected to the first seal portion 141, and the spaces G11 are blocked.

Next, in a sixth step (S156), a space between the inner barrel piece 112 and the outer barrel piece 113, an opening 11*b* of the tubular barrel portion 11 on the terminal part 12 side, and a space between the covering portion W12 and the barrel portion 11 are sealed by the extended seal member 14.

Figure 8:
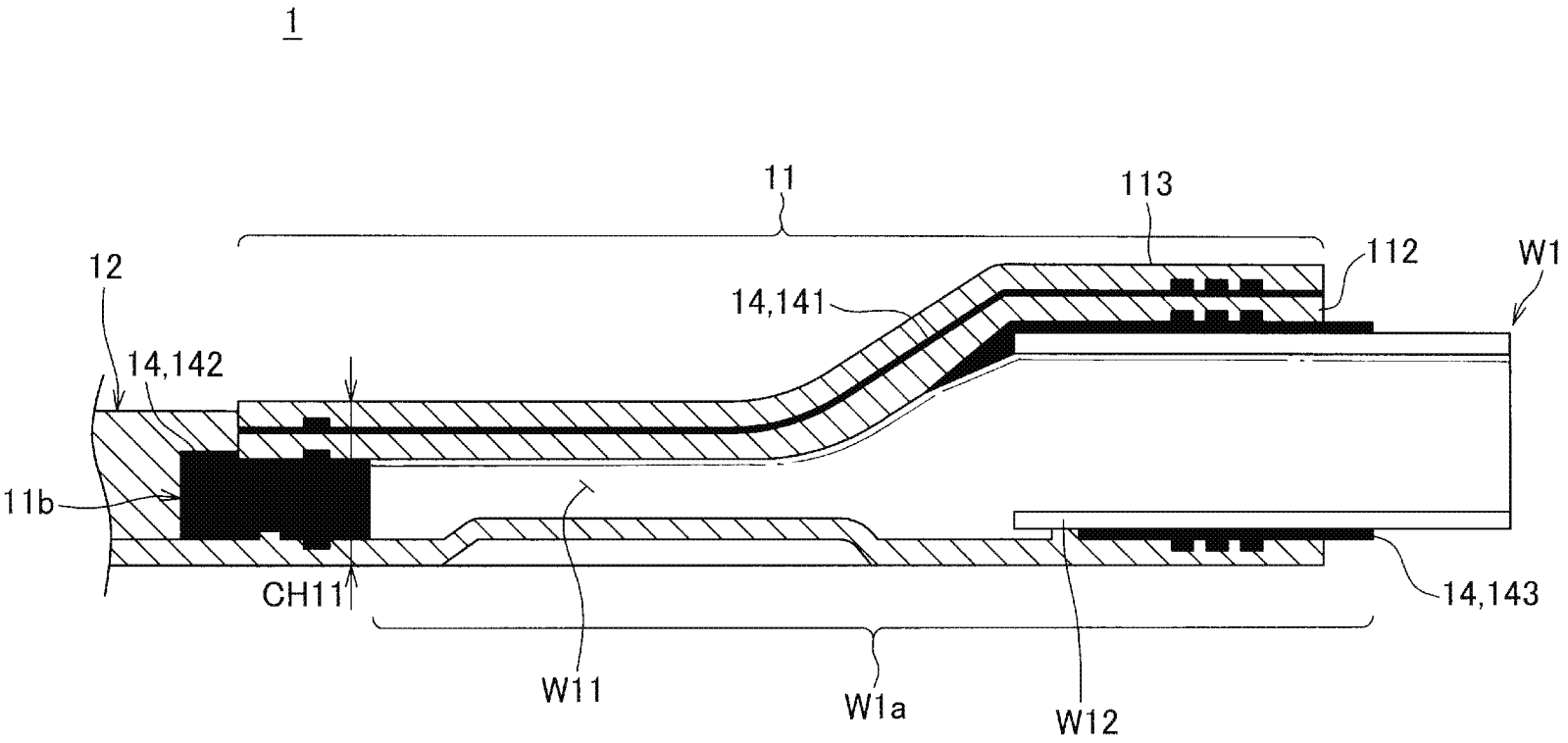
FIG. 8 is a cross-sectional view taken along the line V14-V14 in FIG. 5, showing a state in which the seal member seals each portion of the barrel portion of the crimp terminal after crimping.

FIG. 8 is a cross-sectional view taken along the line V14-V14 in FIG. 5 showing a state in which the seal member seals the respective portions of the barrel portion of the crimp terminal after crimping. As shown in FIG. 8, the space between the inner barrel piece 112 and the outer barrel piece 113 is sealed by the first seal part 141 and the opening 11*b* of the barrel portion 11 on the side of the terminal part 12 is sealed by the second seal part 142. Further, a space between the covering portion W12 and the barrel portion 11 is sealed by the third seal portion 143.

At this time, in the reference example, the dimension in the vertical direction in FIG. 8 (hereinafter referred to as a crimp height CH11) where pressure is mainly applied in the barrel portion 11 after crimping is set to the following dimension. That is, the barrel portion 11 having a cylindrical shape is crushed to such an extent that a part of the seal member 14 formed of an adhesive gel sheet having a certain thickness and width protrudes from the opening 11*b* of the barrel portion 11. By setting the crimp height CH 11 to such a size, the opening 11*b* of the barrel portion 11 is sealed at a high level. A part of the seal member 14 also protrudes from the space between the covering portion W12 and the barrel portion 11 even on the extending side of the covered electric wire W1 in the barrel portion 11 to seal the portion at a high level. In other words, the dimensions such as the widths of the first seal portion 141, the second seal portion 142, and the third seal portion 143 constituting the seal member 14 are dimensions necessary and sufficient for such sealing after crimping.

Further, by forming each portion of the seal member 14 so as to project from the opening 11*b* of the barrel portion 11 or the extending side of the covered electric wire W1, it is possible to visually check these portions are surely sealed with the seal member 14 after the crimping.

Figure 9:
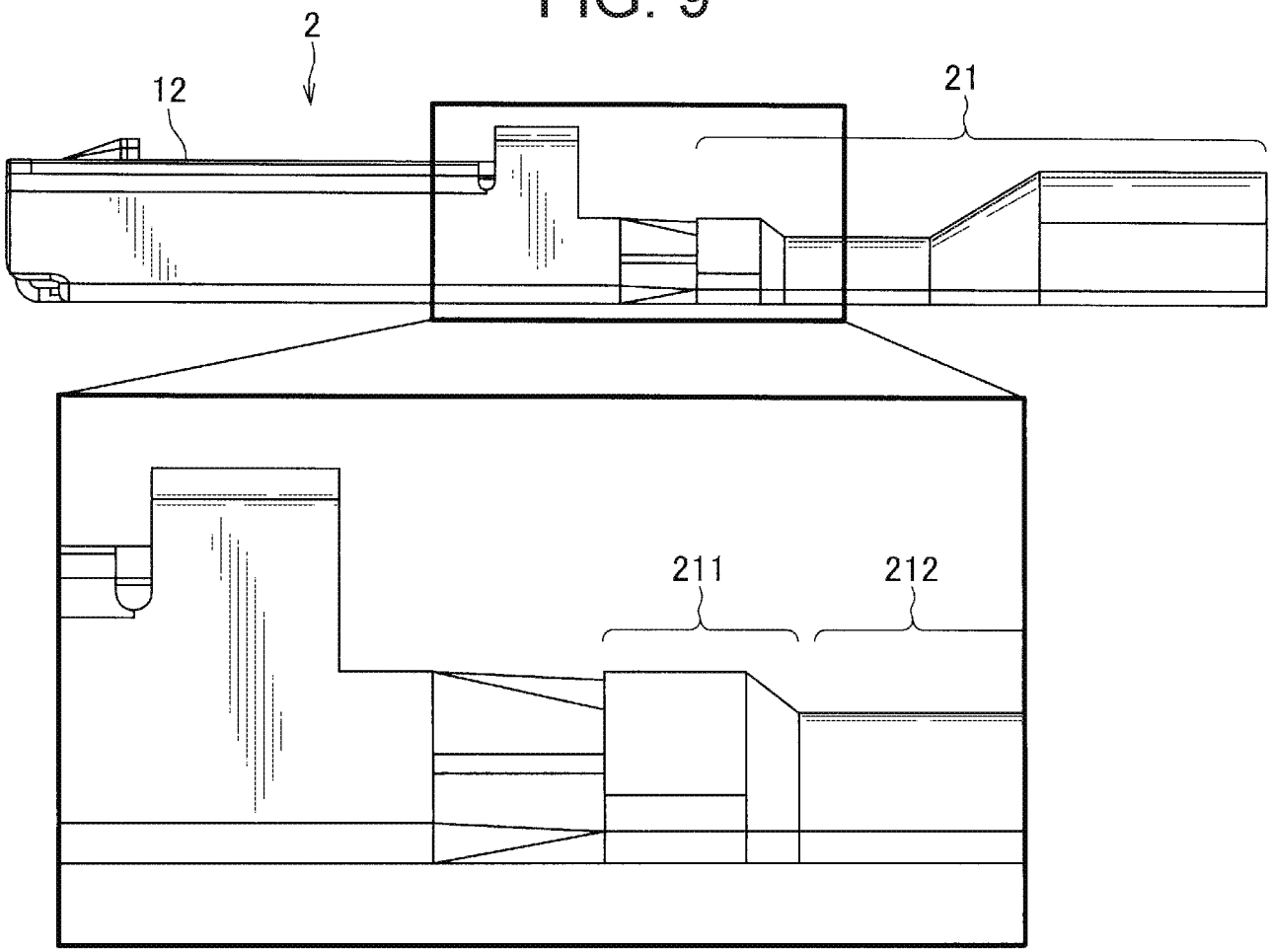
FIG. 9 is a view showing a crimp terminal of a first modification to the crimp terminal of the reference example shown in FIGS. 1 to 8.
Figure 10:
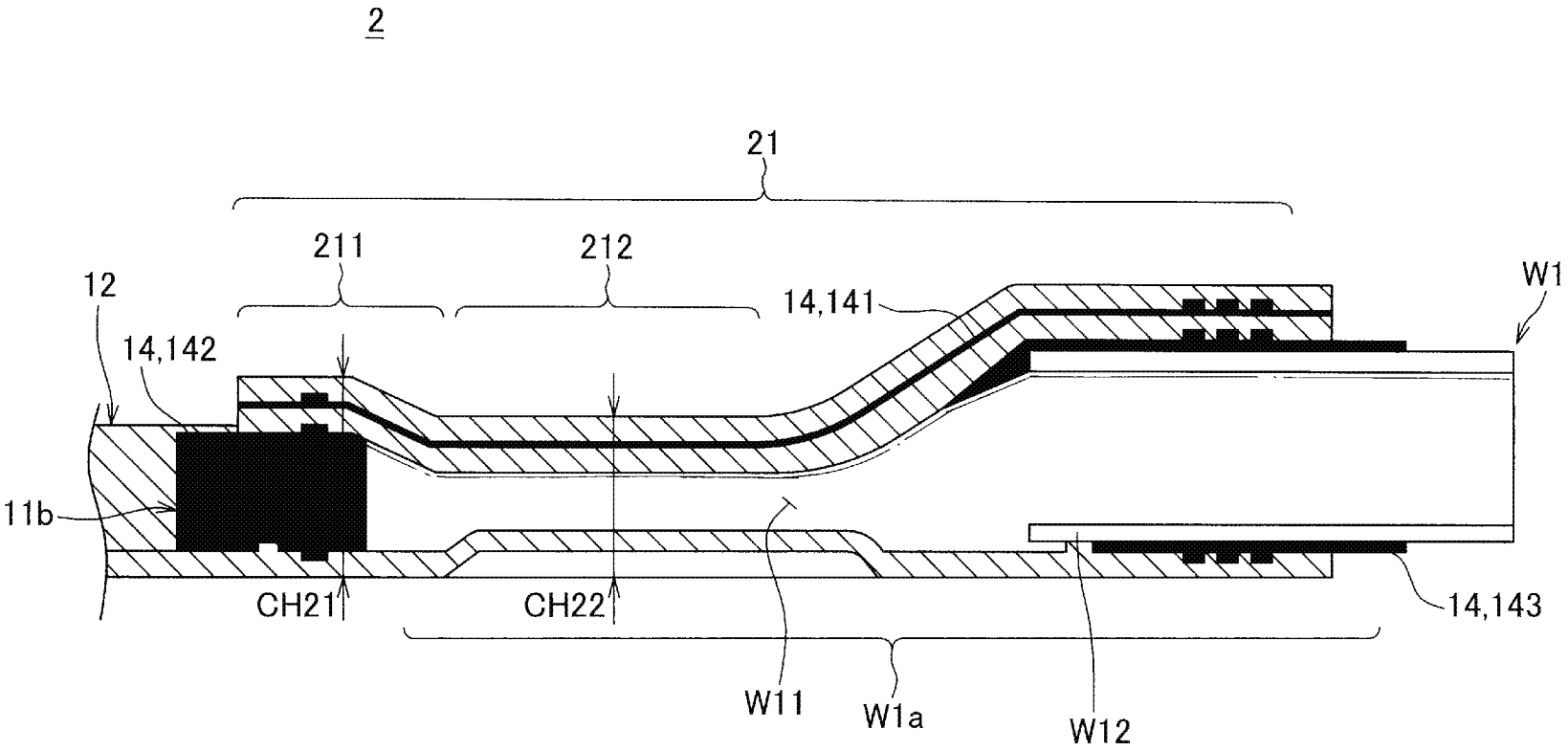
FIG. 10 is a view showing a cross section similar to FIG. 8 of the crimp terminal of the first modification shown in FIG. 9.

FIG. 9 is a view showing the crimp terminal of a first modification to the crimp terminal of the reference example shown in FIGS. 1 to 8, and FIG. 10 is a view showing a cross section similar to FIG. 8 of the crimp terminal of the first modification shown in FIG. 9. Incidentally, in FIGS. 9 and 10, the same elements as those in FIGS. 1 to 8 denote the same reference numerals as those shown in FIGS. 1 to 8, and in the following description, the duplicate explanation of the elements will be omitted.

The crimp terminal 2 of the first modified example is crimped such that the crimp height CH21 of the terminal portion 12 side (hereinafter referred to as a front end portion 211) of the barrel portion 21 after crimping is higher than the crimp height CH22 of the crimping portion 212 of the aluminum core wire W11. Even in this case, the crimp height CH21 of the front end portion 211 has such a size that a part of the seal member 14 projects from the opening 11*b* of the barrel portion 11 and is sealed at a high level. The dimensions such as the width of each portion of the first seal portion 141, the second seal portion 142, and the third seal portion 143 forming the seal member 14 are formed to have dimensions necessary and sufficient for such sealing after crimping. By relatively reducing the crimp height CH22 of the crimp portion 212 as described above, the crimping of the aluminum core wire W11 is strengthened, and the contact reliability with the crimp terminal 2 is improved.

In the crimp terminal 1 of the reference example described above, the edges of the recesses 114 provided on the inner surface 11*a* of the barrel portion 11 bites into the aluminum core wire W1*a* by crimping so that good condition of the covered electric wire W1 and the crimp terminal 1 is obtained. The seal member 14 formed of the adhesive gel sheet is attached to the inner surface 11*a* of the barrel portion 11. After crimping, the seal member 14 seals the spaces between the inner barrel piece 112 and the outer barrel piece 113, the opening 11*b* of the cylindrical barrel portion 11 on the side of the terminal portion 12, the space between the covering portion W12 and the barrel portion 11. This seal member 14 ensures waterproofness against the contact portion which becomes dissimilar metal contact between the aluminum core wire W1*a* and the inner surface 11*a* of the barrel portion 11. Here, in the crimp terminal 1 of the reference example, the seal member 14 is affixed in the divided state in the middle of the path 11*a*-4 from the second region 11*a*-2 to the third region 11*a*-3 via the first region

11*a*-1. That is, in order to obtain waterproofness, the seal member 14, tending to have a complicated shape tracing the path 11*a*-4 as described above, is attached per each divided piece.

Figure 11:
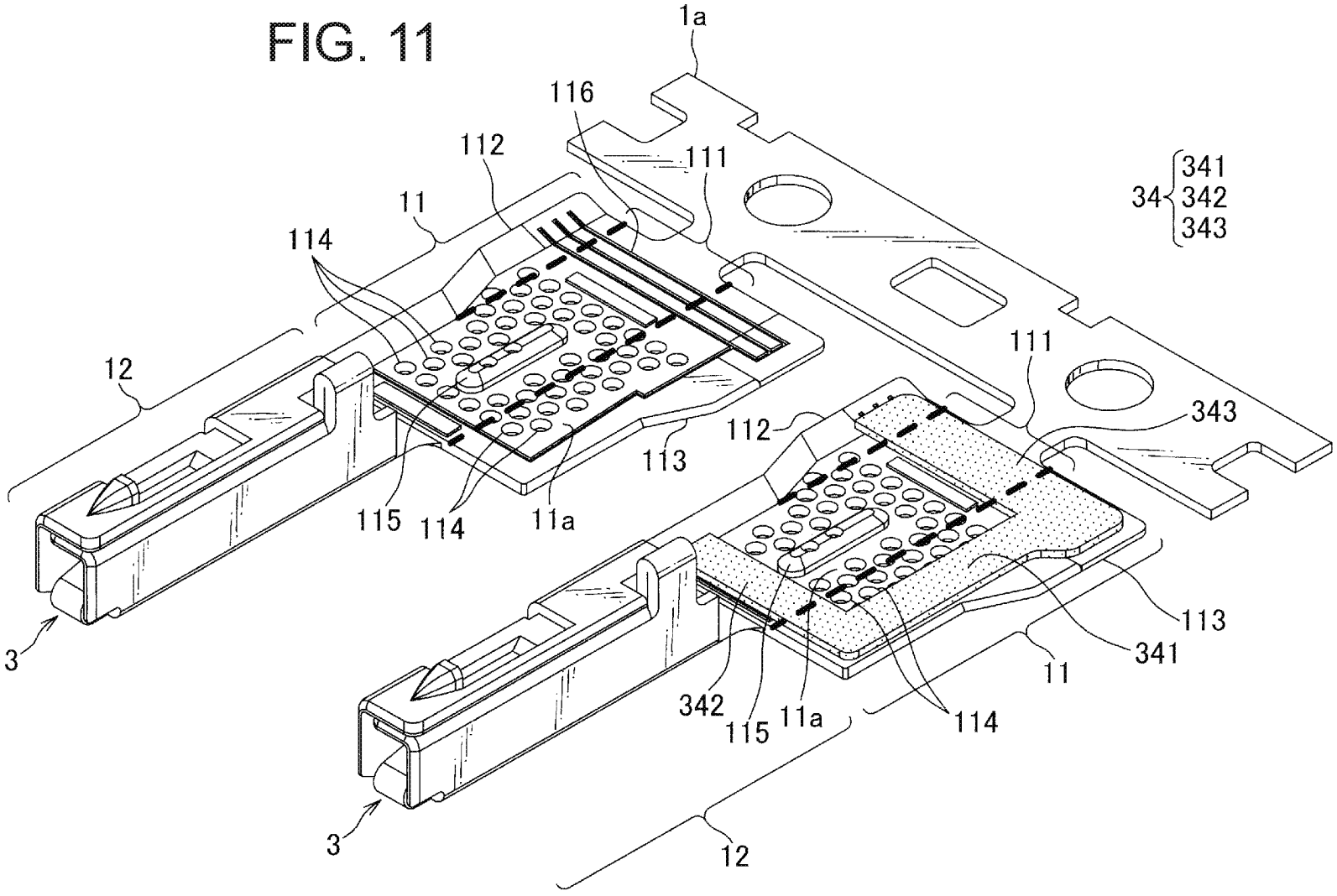
FIG. 11 is a view for explaining a crimp terminal according to a second modification to the crimp terminal of the reference example shown in FIGS. 1 to 8.
Figure 12:
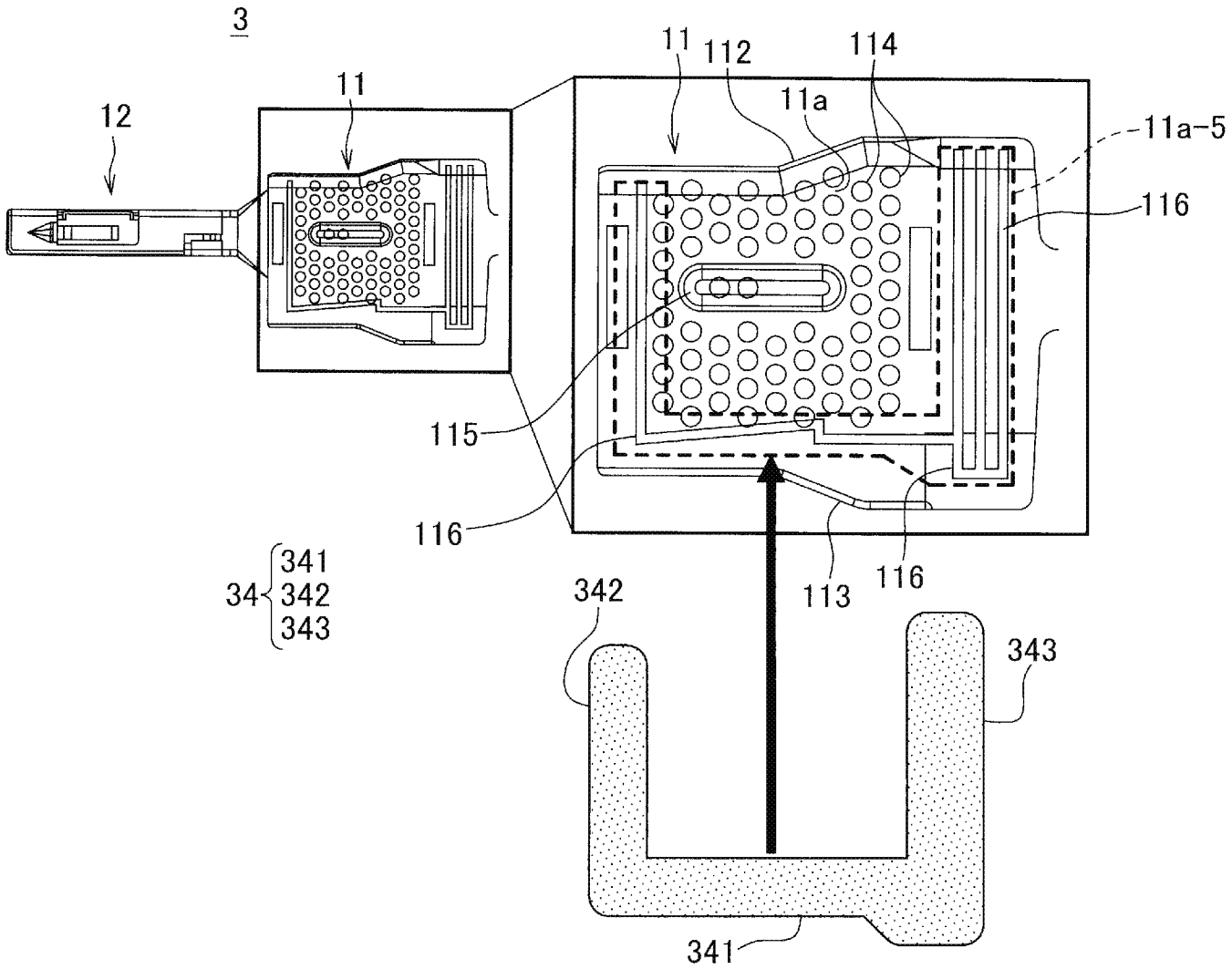
FIG. 12 is a schematic view showing how the seal member shown in FIG. 11 is stuck to the inner surface of the barrel portion.

FIG. 11 is a view for explaining a crimp terminal of the second modification to the crimp terminal of the reference example shown in FIGS. 1 to 8, and FIG. 12 is a view for explaining how the seal shown in FIG. 11 is stuck to the inner surface of the barrel portion. In FIGS. 11 and 12, the same elements as those shown in FIGS. 1 to 8 denote the same reference numerals as those in FIGS. 1 to 8, and duplicate explanation of the elements for the same elements will be omitted. Also in FIG. 11, two crimp terminals 3 are shown, but one crimp terminal 3 is shown with the seal member 34 removed so that the inner surface shape of the barrel portion 11 can be seen.

In the crimp terminal 3 of the second modified example, the seal member 34 is not divided, and the second seal portion 342 and the third seal portion 343 extend in the form of two arms from the first seal portion 341 and are connected integrally formed in a C shape in plan view. This seal member 34 is affixed to the groove portion 116 on the inner surface 11*a* of the barrel portion 11 and a C-shaped region 11*a*-5 overlapping with a part of the plurality of recesses 114 in plan view. When crimping, the first seal portion 341 seals a space between an inner barrel piece 112 and an outer barrel piece 113, the second seal part 342 seals an opening of the tubular barrel portion 11 on the side of the terminal portion 12, and the third seal portion 343 seals a space between the covering portion W12 and the barrel portion 11.

Compared with this second modification, in the crimp terminal 1 of the above-described reference example, the operation of attaching the seal member 14 to be affixed to each of the three pieces of individual pieces becomes easy. As described above, according to the crimp terminal 1 of the reference example, it is possible to alleviate difficulties in manufacturing while securing waterproofness against the contact portion with the aluminum core wire W1*a*.

In addition, in the crimp terminal 1 of the present embodiment, since the seal member 14 is a sheet of an adhesive gel whose thickness has been determined in advance, the quantity of the gel for sealing the above-mentioned portions can be easily and accurately adjusted at the time of production without excess or deficiency depending on the area of the seal member 14. According to the crimp terminal 1 of the reference example, also in this sense, as compared with coating a gel-like resin material for sealing or the like, while securing waterproofness at a high level, it is possible to alleviate difficulties in manufacturing.

Here, in the crimp terminal 1 of the reference example, while the divided seal member 14 is extended and connected by crimping as described above with reference to FIG. 7, the elongation rate by crimping becomes larger in the cross direction D12 than in the axial direction D11. In the crimp terminal 1 of the reference example, since the seal member 14 is divided across the path 11*a*-4 in the axial direction D11, at the time of crimping, the split portions are connected by the extension in the cross direction D12 having a large elongation rate. Therefore, higher waterproofness can be secured.

In addition, in the crimp terminal 1 of the reference example, the seal member 14 is attached in a very simple shape in which all of the first seal portion 141, the second seal portion 142, and the third seal portion 143 are in the form of a single belt. Thus, according to the crimp terminal 1 of the reference example, it is possible to further alleviate difficulties in manufacturing.

In the crimp terminal 1 of the reference example, the groove portion 116 is formed on the inner surface 11*a* of the barrel portion 11 so as to overlap the seal member 14, and the plurality of recesses 114 is provided avoiding the groove portion 116. As a result, the movement of the seal member 14 due to the pressure applied at the time of crimping is suppressed by the groove portion 116 overlapping with the seal member 14. Therefore, according to the crimp terminal 1 of the reference example, it is possible to alleviate difficulties in manufacturing while securing waterproofness at a higher level.

In addition, the groove 116 provided in the inner surface 11*a* of the barrel portion 11 contributes to securing at a high level waterproofness also in the following points.

Figure 13:
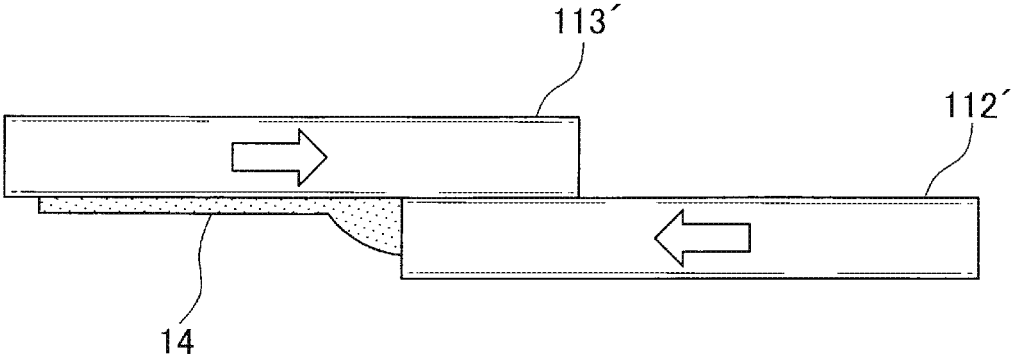
FIG. 13 is a schematic view showing an example in which a groove portion is not provided on the inner surface of the barrel portion as a comparative example for explaining that the groove portion provided on the inner surface of the barrel portion contributes to securing a high level of waterproofness.
Figure 14:
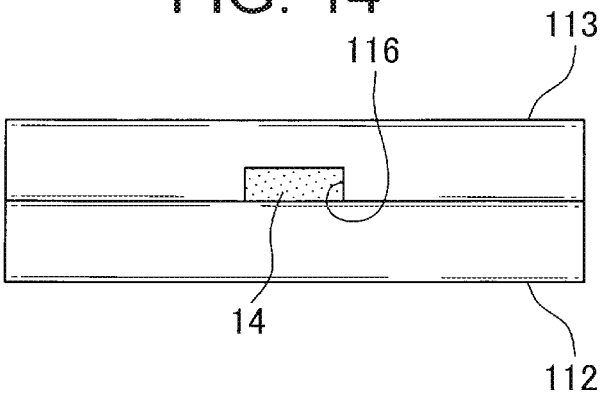
FIG. 14 is a view showing that the groove provided on the inner surface of the barrel portion contributes to securing high waterproofness at a high level in comparison with the example of FIG. 13.

FIG. 13 is a schematic view showing an example in which a groove portion provided on the inner surface of the barrel portion is not provided with the groove portion on the inner surface of the barrel portion as a comparative example for explaining that a groove portion provided on the inner surface of the barrel portion contributes to securing a high level of waterproofness. In addition, FIG. 14 is a view showing that the groove provided on the inner surface of the barrel portion contributes to securing the waterproofness at a high level in comparison with the example of FIG. 13.

In the comparative example shown in FIG. 13, the seal member 14 affixed to the outer barrel piece 113' may be brought close to one side by the edge of the inner barrel piece 112' during crimping. On the other hand, if the groove portion 116 is provided so as to overlap with the seal member 14, at least within the groove portion 116 a part thereof is secured even if the seal member 14 is forced close to one side as shown in FIG. 14. As a result, the groove 116 provided in the inner surface 11*a* of the barrel portion 11 contributes to securing high waterproofness.

Further, according to the terminal manufacturing method of the reference example described with reference to FIGS. 1 and 2, since the seal member 14 is attached in a divided state, it is possible to ensure waterproofness against the contact portion with the aluminum core wire W1*a* while alleviating the difficulty in manufacturing. Further, according to the terminal manufacturing method of the reference example since the seal member 14 is formed of the adhesive gel sheet, difficulty in manufacturing can be alleviated while ensuring waterproofness at a high level.

As described above, in the crimp terminal 1 of the reference example, the edge of each recess 114 provided on the inner surface 11*a* of the barrel portion 11 bites into the aluminum core wire W11 by crimping, whereby good conduction between the covered electric wire W1 and the crimp terminal 1 can be obtained. That is, it can be said that the plurality of recesses 114 in a dispersed manner is provided and serrations are formed on the inner surface 11*a* of the barrel portion 11. The degree of conduction in the serration is determined by the sum of the lengths of the portions biting into the aluminum core wire W11 per unit area.

Figure 15:
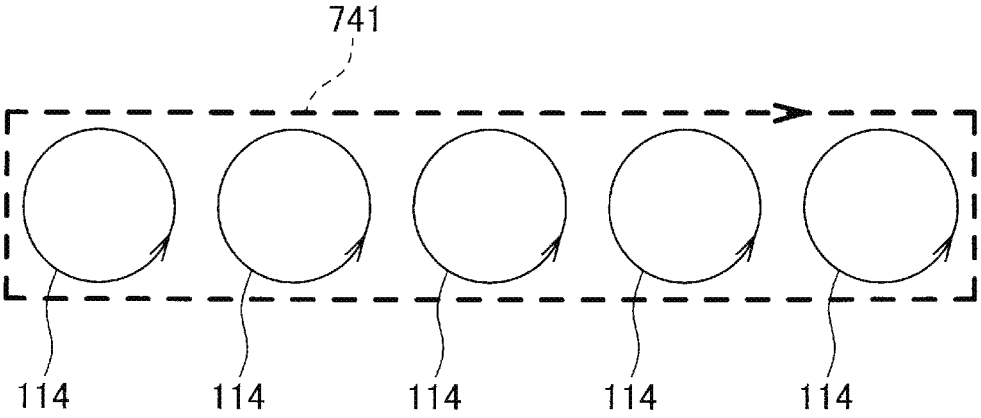
FIG. 15 is a schematic view showing that a degree of conduction with the aluminum core wire in the crimp terminal shown in FIGS. 1 to 8 is determined by the sum of the lengths of the portions biting into the aluminum core wire per unit area.

FIG. 15 is a schematic view showing that the degree of conduction with the aluminum core wire in the crimp terminal shown in FIGS. 1 to 8 is determined by the sum of the lengths of the portions biting into the aluminum core wire per unit area.

Figure 49:
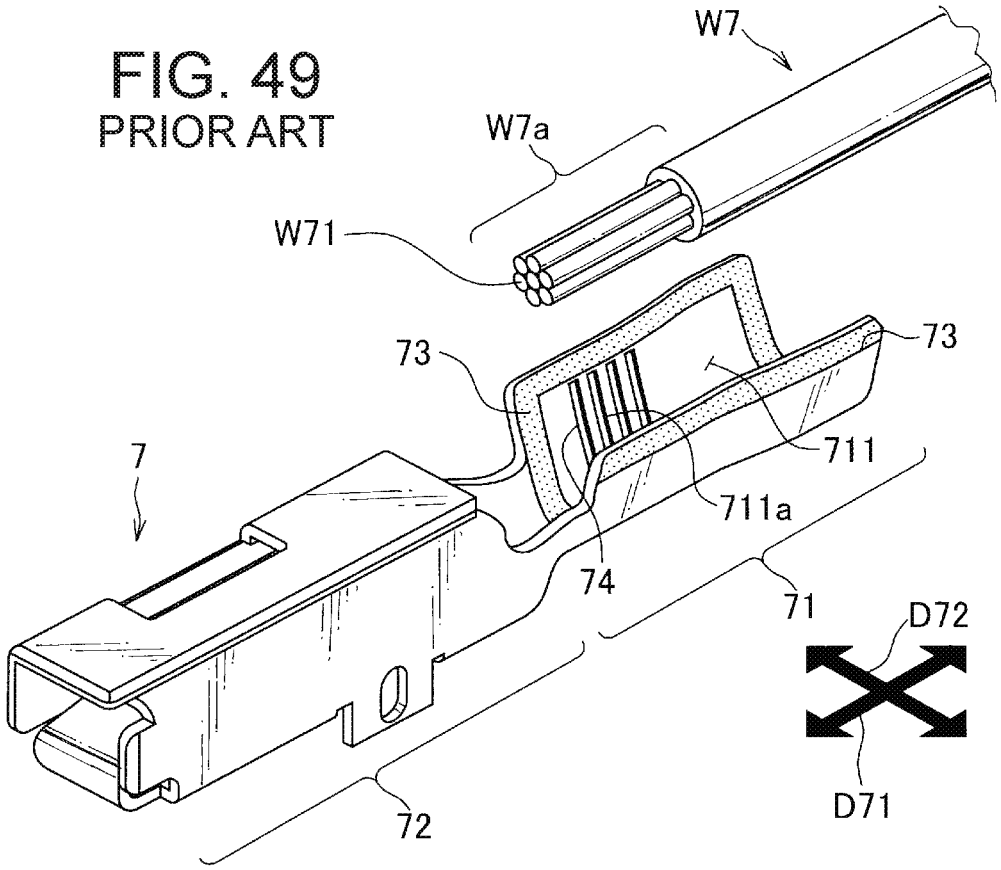
FIG. 49 PRIOR ART
FIG. 49 is a view showing an example of a conventional crimp terminal surrounding a contact portion between a barrel portion and an aluminum core wire with a seal member.

In the crimp terminal 1, the sum of the lengths of the portions biting into the aluminum core wire W11 is the total of the circumferential lengths of the circularly-formed recesses 114. On the other hand, for example, in the groove 741 forming the serration 74 shown in FIG. 49, the lengths of the edges of the linearly extending grooves 741 becomes the sum, but when viewed per unit area, the total of the circumferential lengths of the plurality of recesses 114 formed in the outer circumferential side in this sum becomes longer. In other words, according to the crimp terminal 1 of the reference example, the area of the serration necessary for obtaining good conduction between the covered electric wire W11 and the crimp terminal 1 is suppressed compared with, for example, the conventional crimp terminal 7 and so on. Since the area of the serration is suppressed, a space for providing the seal member 14 in order to ensure waterproofing against the contact portion with the aluminum core wire W11 can be widened, and the difficulty in manufacturing can be alleviated. That is, according to the crimp terminal 1 of the reference example, it is possible to alleviate difficulties in manufacturing while securing waterproofness against the contact portion with the aluminum core wire W11 also in this respect.

In addition, the circular recesses 114 are stronger in resisting force against the force of expanding the recesses 114 in the in-plane direction of the inner surface 11*a* of the barrel portion 11 than, for example, a linear groove or the like. The pressure applied to the barrel portion 11 at the time of crimping is just the force acting in the in-plane direction of the inner surface 11*a* of the barrel portion 11. In the crimp terminal 1 of the reference example, the resistance force at each recess to such pressure is strong.

Figure 16:
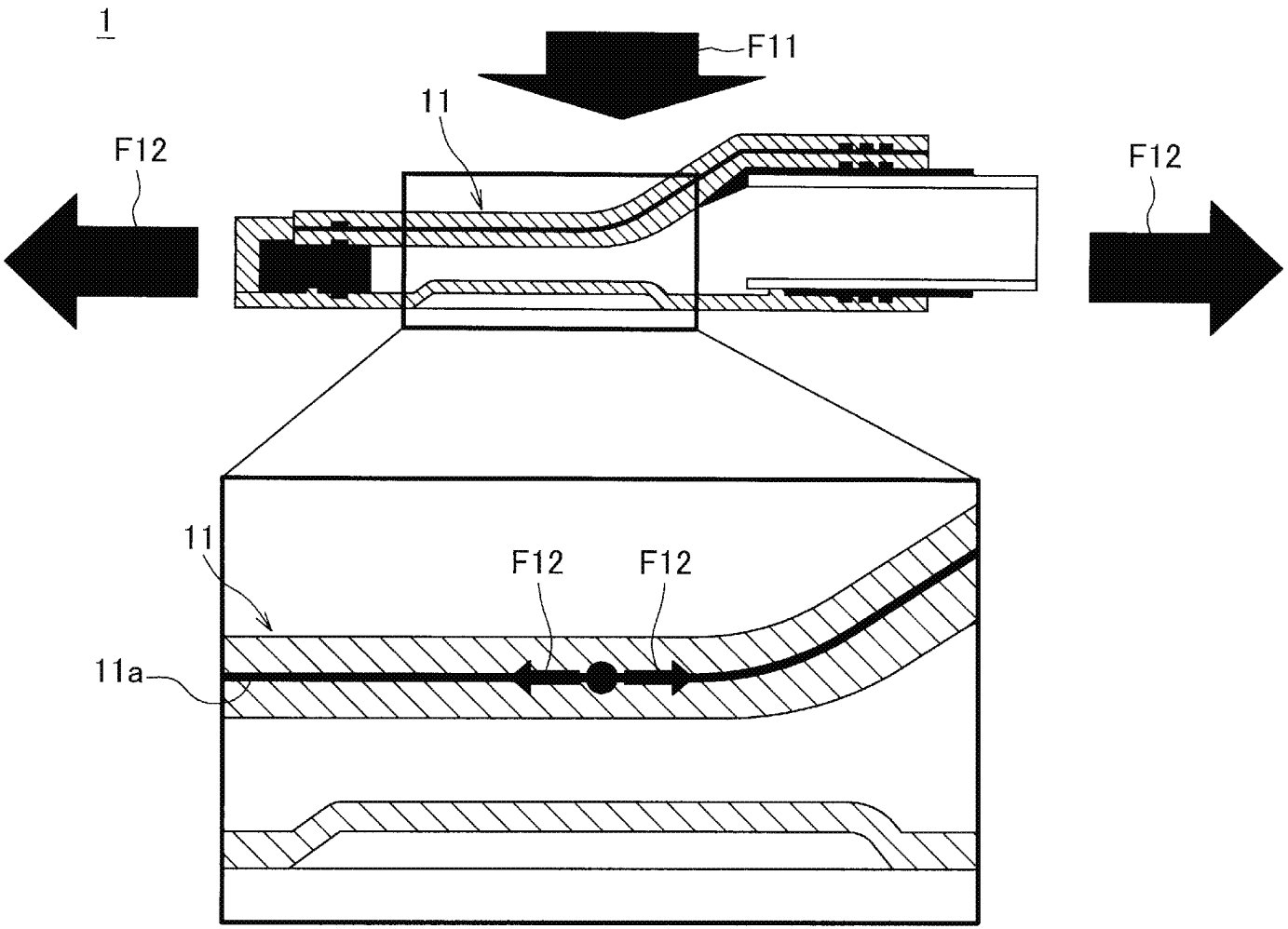
FIG. 16 is a schematic view showing a pressure applied to the barrel portion during crimping.

FIG. 16 is a schematic diagram showing the pressure applied to the barrel portion during crimping.

As shown in FIG. 16, at the time of crimping, a force F11 for crushing the barrel portion 11 of the crimp terminal 1 is applied to the barrel portion 11 by a pressing device or the like (not shown). When such a force F 11 is applied, a force F12 for expanding the recesses 114 in the in-plane direction of the inner surface 11*a* is generated in the barrel portion 11.

Figure 17:
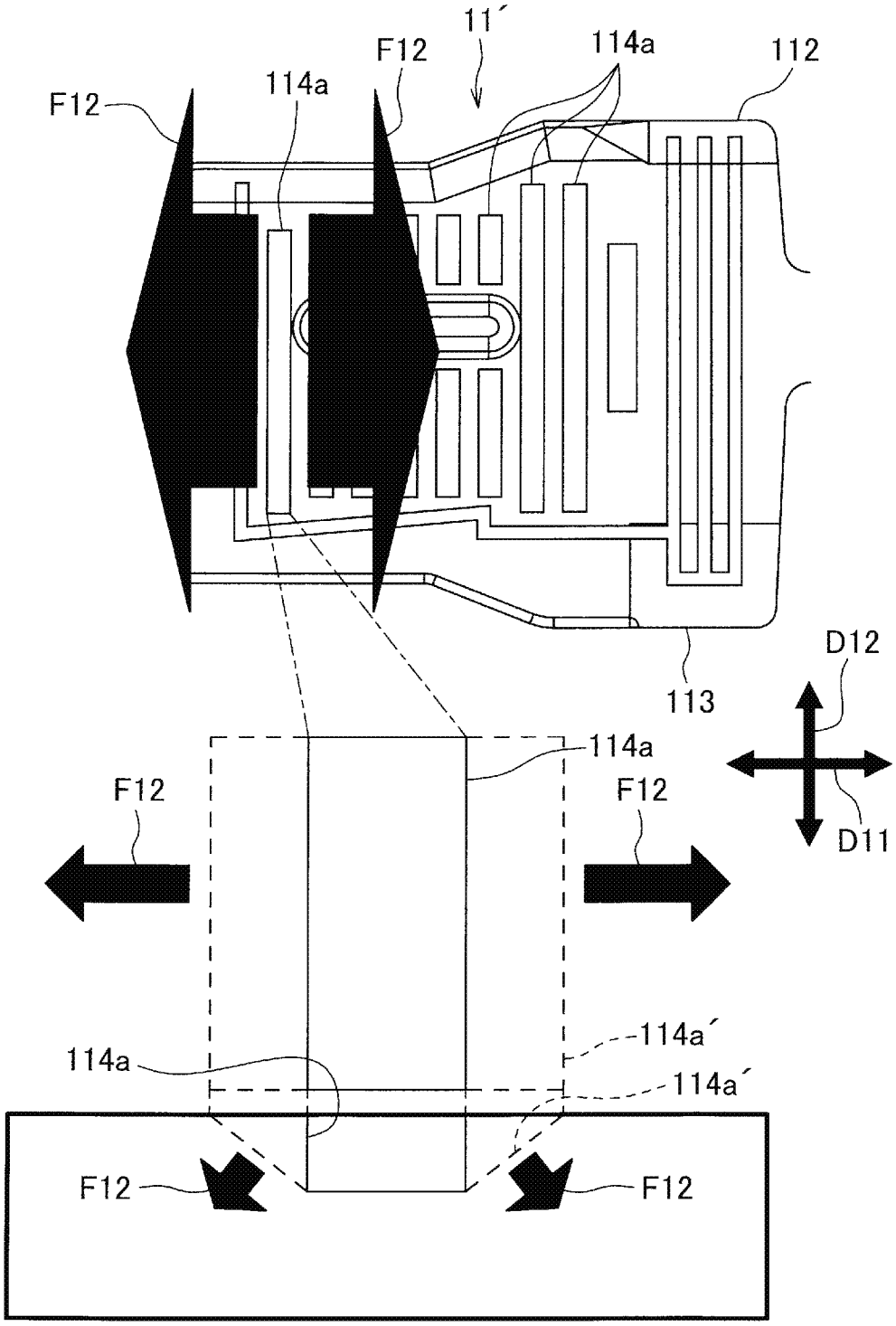
FIG. 17 is a view explaining an influence due to a force generated at the barrel portion at the time of crimping, taking a barrel portion provided with a linear groove as a comparative example instead of a recess.

FIG. 17 is a view for explaining the influence of the force generated in the barrel portion at the time of crimping, taking the barrel portion in which a linear groove is provided as a comparative example instead of the recess. In FIG. 17, the same reference numerals as those in FIGS. 1 to 8 denote the same elements as those shown in FIGS. 1 to 8, and the same elements will be not described below.

In the comparative example of FIG. 17, a plurality of linear grooves 114*a* is provided in parallel in place of the circular recesses 114 of the crimp terminal 1 of the reference example as serving the serration. Each of the grooves 114*a* is provided along the intersecting direction D12 that intersects the axial direction D11. In this comparative example, when a force F12 in the in-plane direction as shown in FIG. 16 is applied, each groove 114*a* is deformed into a deforming groove 114*a*' whose width is widened. Deforming each groove 114*a* into the deforming groove 114*a*' makes the barrel portion 11' extend in the axial direction D11. In this case, the seal member 14 provided in the barrel portion 11' also follows and extends, but if this extension is excessively large, for example, in the seal member 14 etc. between the inner barrel piece 112 and the outer barrel piece 113, unevenness or the like of the member 14 occurs, which may lower the waterproofness.

In contrast to this comparative example, in the crimp terminal 1 of the reference example, the resistance force against the force F 12 that tends to widen the recesses 114 in the in-plane direction of the inner surface 11*a* is strong.

Figure 18:
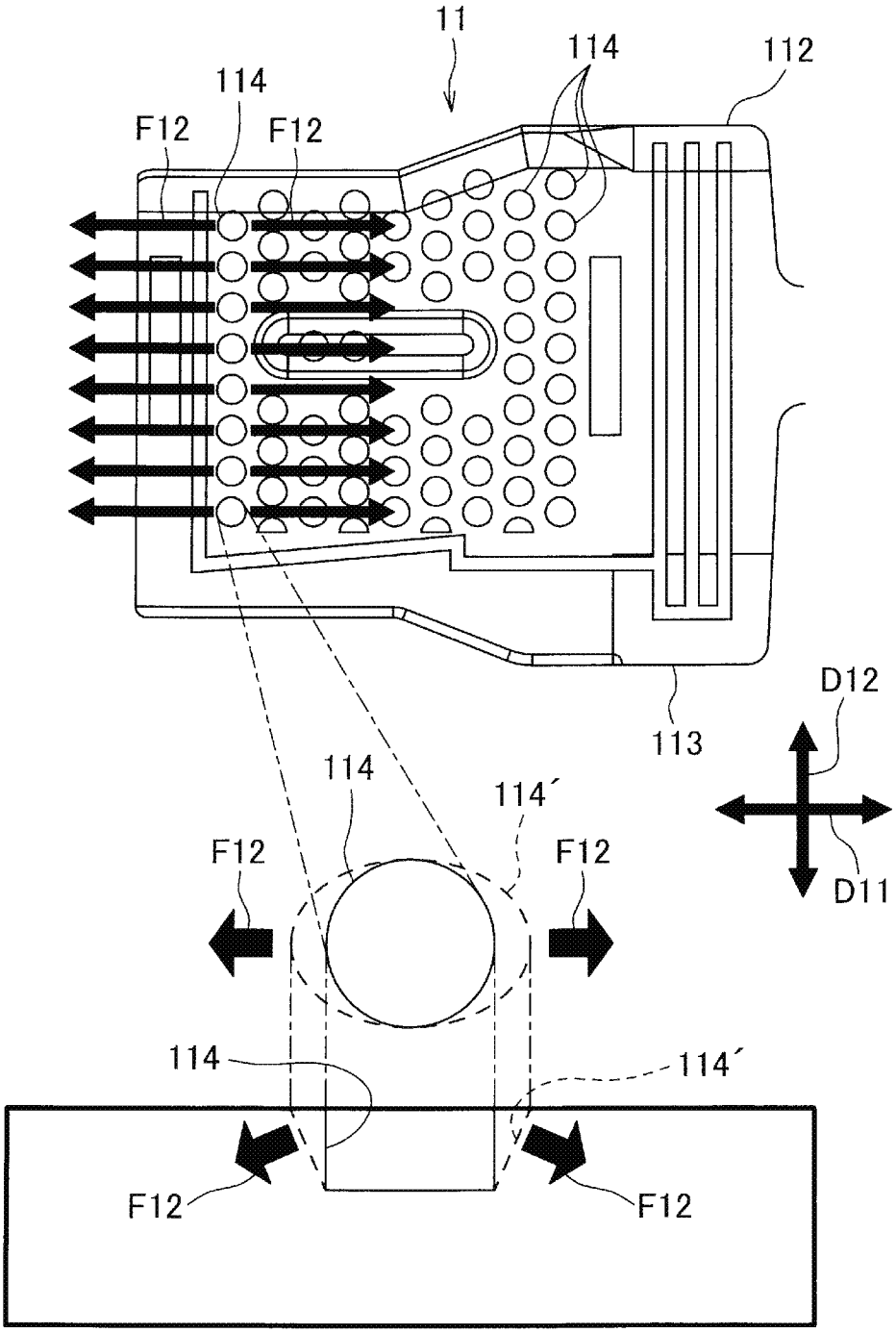
FIG. 18 is a view for explaining that the crimp terminal of the reference example has a strong resistance against a force to widen the recess.

FIG. 18 is a view for explaining that the crimp terminal of the reference example has a strong resistance to a force to widen the recesses.

In the circular recesses 114, most of the inner peripheral surface of the circular recesses 114 obliquely intersects the force F12 and acts to suppress deformation that expands the recesses 114. Thereby, in the crimp terminal 1 of the reference example, extension of the barrel portion 11 due to the pressure F11 applied during crimping is suppressed. As a result, extension of the seal member 14 is also suppressed, and waterproofness can be secured at a high level. According to the crimp terminal 1 of the reference example, also in this sense, it is possible to alleviate difficulties in manufacturing while securing waterproofness against the contact portion with the aluminum core wire W1*a*.

Hereinafter, as a modification of the aforementioned first modified example and second modified example to the crimp terminal 1 of the reference example, a modified example of the recess 114 provided on the inner surface 11*a* of the barrel portion 11 will be described.

Figure 19:
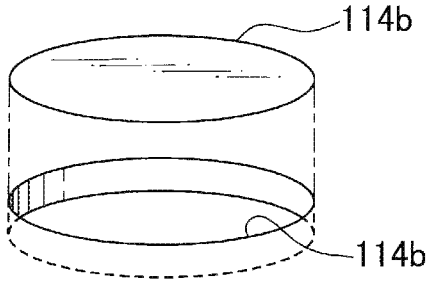
FIG. 19 is a view showing a recess according to a third modification of the crimp terminal of the reference example shown in FIGS. 1 to 8.
Figure 20:
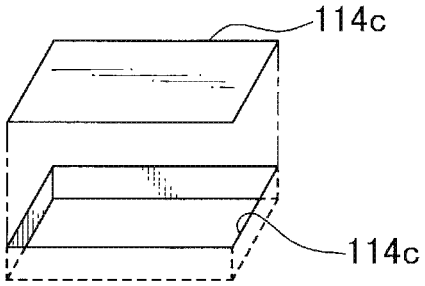
FIG. 20 is a view showing a recess according to a fourth modification of the crimp terminal of the reference example shown in FIGS. 1 to 8.
Figure 21:
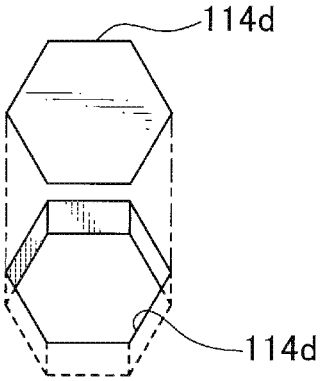
FIG. 21 is a view showing a recess according to a fifth modification of the crimp terminal of the reference example shown in FIGS. 1 to 8.

FIG. 19 is a view showing a recess according to a third modification of the crimp terminal of the reference example shown in FIGS. 1 to 8. FIG. 20 is a view showing a recess in the fourth modified example of the crimp terminal of the reference example shown in FIGS. 1 to 8. FIG. 21 is a view showing a recess in a fifth modification to the crimp terminal of the reference example shown in FIGS. 1 to 8.

The recess 114*b* in the third modification shown in FIG. 19 is formed in an elliptical shape in plan view. In addition, the recess 114*c* in the fourth modification shown in FIG. 20 is formed in a parallelogram in plan view. Further, the recess 114*d* in the fifth modification shown in FIG. 21 is formed in a hexagonal shape in plan view.

Besides this, as a modification example of the crimp terminal 1 of the reference example, a triangle or another polygon in plan view and the like can be mentioned. In any of these modifications, as compared with the linear groove 114*a* shown in FIG. 17, the resistance force against the force F12 to expand in the in-plane direction of the inner surface 11*a* is strong. It is noted that the elliptical recess 114*b* in the third modified example has the same strength as the circular recesses 114 in the reference example. On the other hand, the parallelogram-shaped recesses 114*c* in the fourth modified example and the hexagonal recessed portions 114*d* in the fifth modified example are compared with the circular recesses 114 in the reference example or the elliptical recess 114*b* in the third modified example, the resistance becomes weak.

Here, in the crimp terminal 1 of the reference example, as described above, a part of the plurality of recesses 114 provided on the inner surface 11*a* of the barrel portion 11 overlaps the seal member 14. The crimp terminal 1 of the reference example has the following advantages in this respect.

Figure 22:
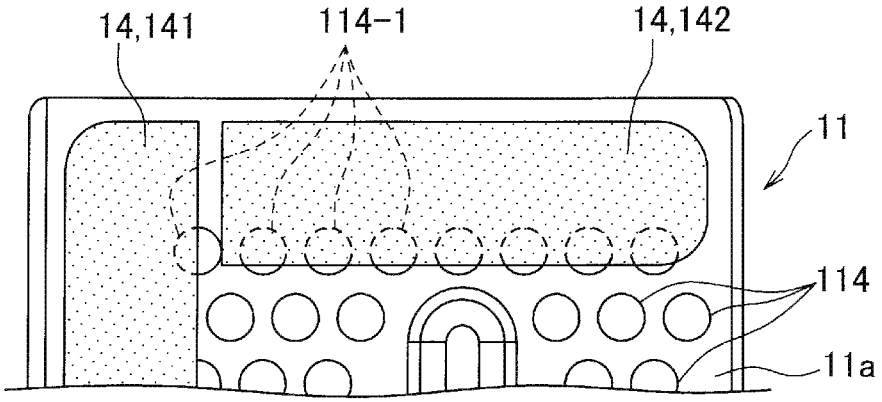
FIG. 22 is a view for explaining an advantageous point that a part of the plurality of recesses overlaps with a seal member.

FIG. 22 is a view for explaining an advantageous point that the part of a plurality of recesses overlap with the seal member.

In the crimp terminal 1 of the reference example, first, the first seal portion 141 attached to the outer barrel piece 113 side of the seal member 14 partially overlaps with the recess 114-1 positioned at the edge side of the outermost barrel piece 113 of the plurality of recesses 114. As a result, the recesses 114-1 at a position overlapping with the first seal portion 141 can be used as a mark for providing the first seal portion 141 of the barrel portion 11 on the inner surface 11*a*. Also, the second seal portion 142 affixed to the terminal portion 12 side partially overlaps the recess 114-1 located closest to the terminal portion 12. As a result, the recesses 114-1 at a position overlapping with the second seal portion 142 can be used as a mark for providing the second seal portion 142 of the barrel portion 11 on the inner surface 11*a*. According to the crimp terminal 1 of the reference example, it is possible to alleviate difficulties in manufacturing at these points. In addition, the recesses 114-1 overlapping the first seal portion 141 and the second seal portion 142 suppress the movement of the first seal portion 141 and the second seal portion 142 due to the pressure applied at the time of crimping, contributing to the waterproofness at a higher level as well. As described above, according to the crimp terminal 1 of the reference example, utilizing the recesses 114 provided for good conduction between the covered electric wire W1 and the crimp terminal 1 while securing the waterproof property against the contact portion with the aluminum core wire W11 can alleviate difficulties in manufacturing.

Further, according to the crimp terminal 1 of the reference example, the movement of the seal member 14 due to the pressure applied at the time of crimping is also suppressed by the groove portion 116 overlapping with the seal member 14. According to the crimp terminal 1 of the reference example, it is possible to relieve difficulties in manufacturing while securing waterproofness at a higher level in this respect. Further, the groove 116 overlapping the seal member 14 can also be used as the marker for providing the seal member 14 on the inner surface 11*a* of the barrel portion 11, so that it is possible to further alleviate manufacturing difficulties in this point.

Further, in the crimp terminal 1 of the reference example, as described above, since the high degree of conduction is secured by forming the serrations by the plurality of recesses 114, even if the seal member 14 overlaps somewhat unduly recesses 114, the influence on conduction is small. Therefore, it is unnecessary to strictly perform the alignment when sticking the seal member 14, so that it is possible to further alleviate the manufacturing difficulty even in this point.

Next, a modified example of the shape of the seal member 14 affixed to the inner surface 11*a* of the barrel portion 11 will be described as another modified example of the above-described first to fifth modifications to the crimp terminal 1 of the reference example.

Figure 23:
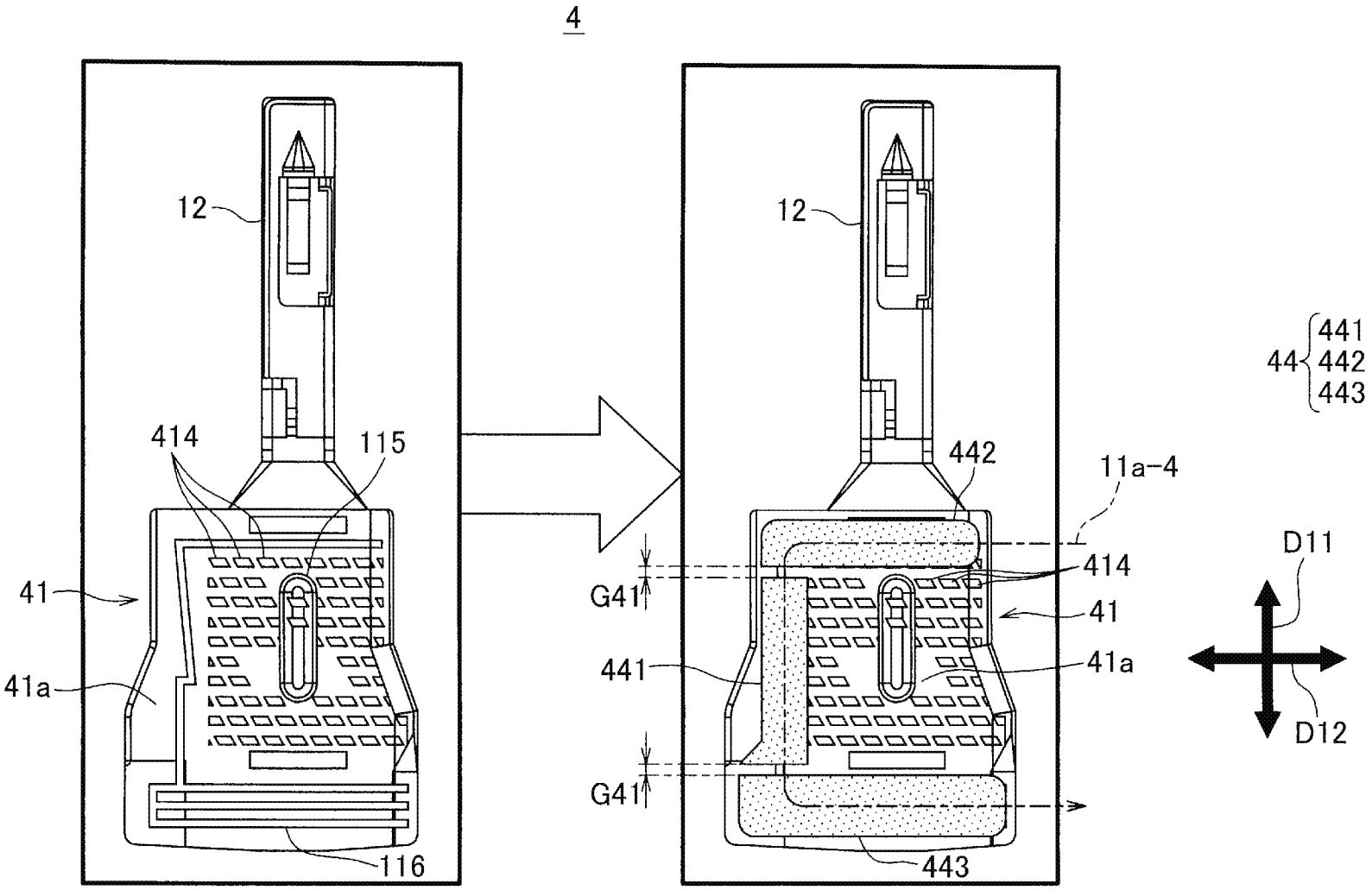
FIG. 23 is a view showing a sixth modified example of the crimp terminal of the reference example shown in FIGS. 1 to 8.

FIG. 23 is a view showing a sixth modification of the crimp terminal of the reference example shown in FIGS. 1 to 8. In the sixth modification, not only the shape of the seal member but also the shape of the recesses are different from the crimp terminal 1 of the reference example. In addition, in FIG. 23, the same reference numerals as those in FIGS. 1 to 8 denote the elements equivalent to the elements shown in FIGS. 1 to 8, and hereinafter, the redundant description for the same elements will be omitted.

In the crimp terminal 4 according to the sixth modification, first, the recesses 414 provided in the inner surface 41*a* of the barrel portion 41 are those of parallelogram in plan view as shown as the fourth modification in FIG. 20.

In the seal member 44 according to the sixth modification, the second seal portion 442 and the third seal portion 443 are each divided from the first seal portion 441 across the path 11*a*-4 in the cross direction D12. Slight spaces G41 open in the axial direction D11 between the second seal portion 442 and the third seal portion 443, and the first seal portion 441. The spaces G41 are closed by the extension of the seal member 44 at the time of crimping.

Figure 24:
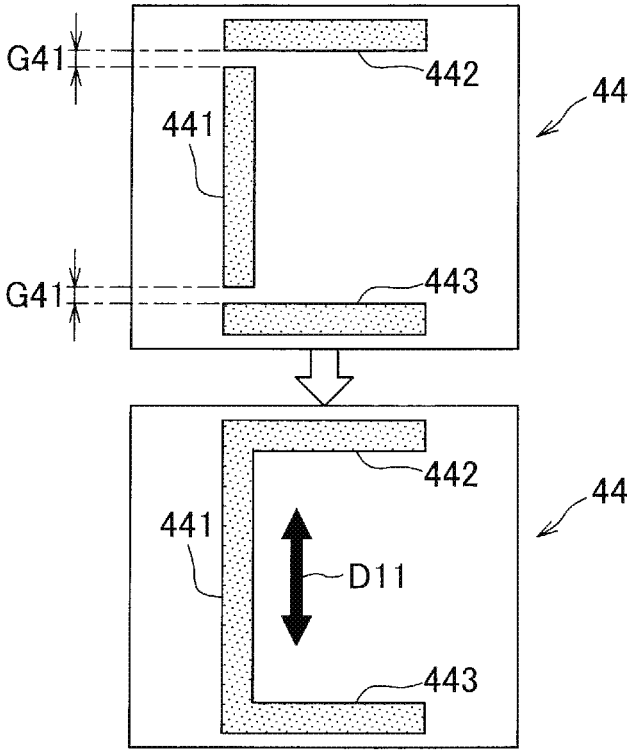
FIG. 24 is a schematic view showing how the space between the second seal portion and the third seal portion, and the first seal portion shown in FIG. 23 is blocked by extension of the seal member at the time of crimping.

FIG. 24 is a schematic view showing how the spaces between the second seal portion and the third seal portion, and the first seal portion shown in FIG. 23 are blocked by extension of the seal member at the time of crimping.

As shown in FIG. 24, at the time of crimping, the first seal portion 441 is extended in the axial direction D11 which coincides with the length direction thereof. Due to this extension, the second seal portion 442 and the third seal portion 443 are connected to the first seal portion 441, and the spaces G41 are closed. It is noted that the extension ratio at the time of crimping is larger in the cross direction D12 than in the axial direction D11. Therefore, although the extent of extension becomes smaller as compared with the case of the reference example described with reference to FIG. 7 and the like, appropriately adjusting the spaces G41 generated at the time of bonding makes the spaces G 41 blocked at the time of crimping, securing a high level of waterproofness.

Next, further modification to the shape of the seal member 14 in the reference example will be described.

Figure 25:
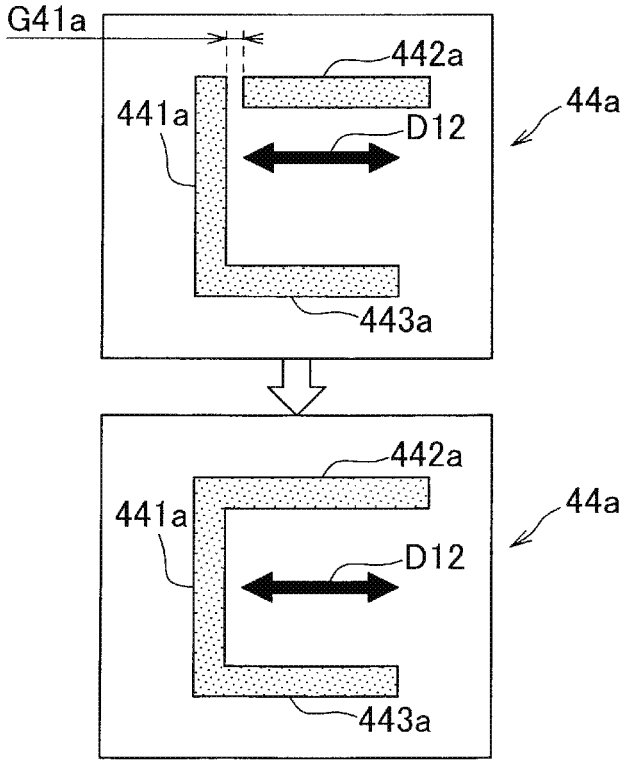
FIG. 25 is a view showing a seal member in a seventh modification example of the crimp terminal of the reference example shown in FIGS. 1 to 8.
Figure 26:
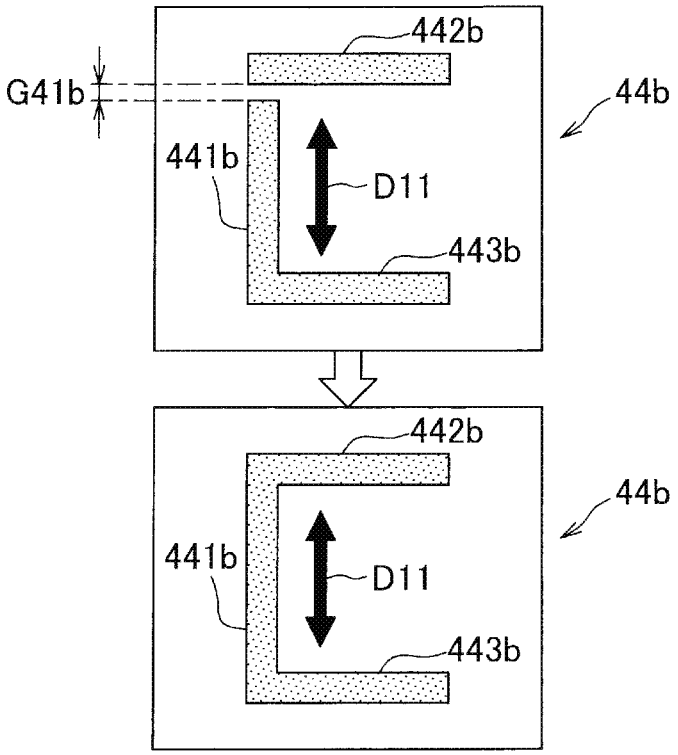
FIG. 26 is a view showing a seal member in an eighth modification example of the crimp terminal of the reference example shown in FIGS. 1 to 8.
Figure 27:
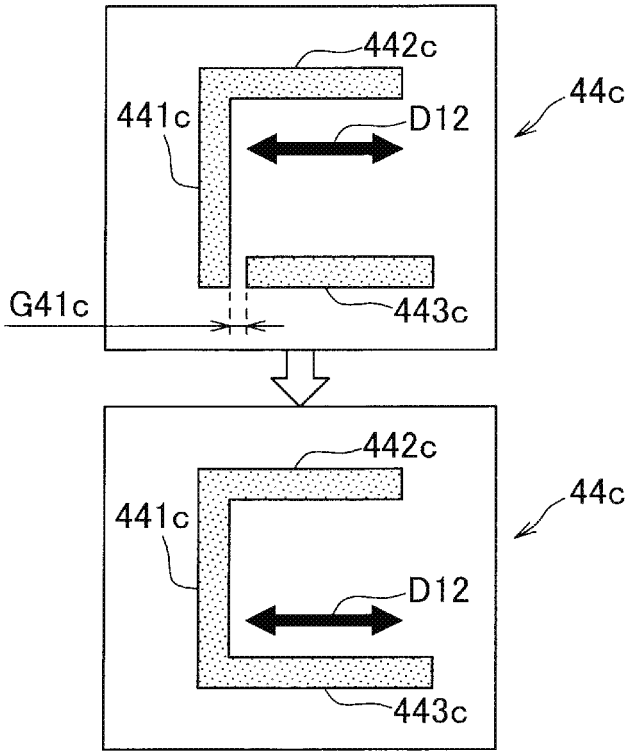
FIG. 27 is a view showing a seal member in a ninth modification example to the crimp terminal of the reference example shown in FIGS. 1 to 8.
Figure 28:
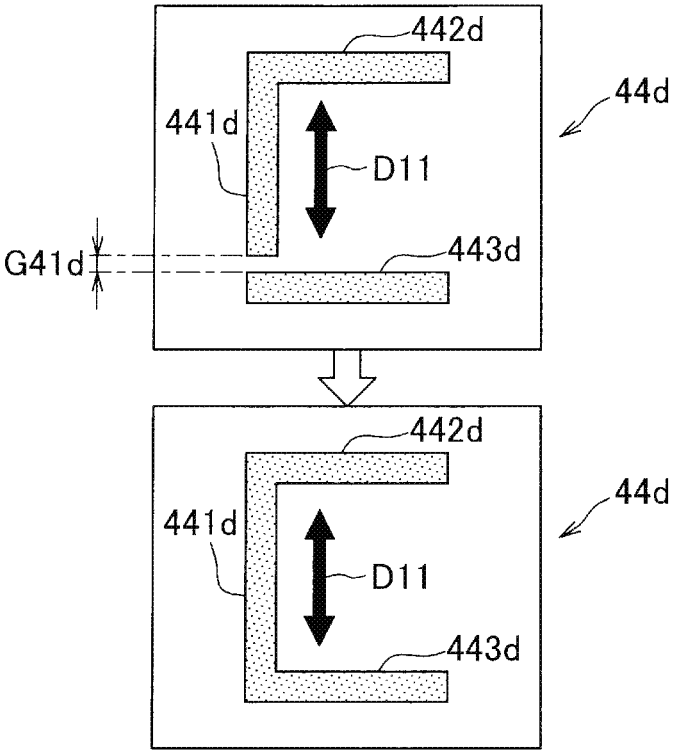
FIG. 28 is a view showing a seal member in a tenth modification example of the crimp terminal of the reference example shown in FIGS. 1 to 8.

FIG. 25 is a view showing a seal member in a seventh modified example of the crimp terminal of the reference example shown in FIGS. 1 to 8. FIG. 26 is a view showing a seal member in an eighth modification example of the crimp terminal of the reference example shown in FIGS. 1 to 8. FIG. 27 is a view showing a seal member in a ninth modification to the crimp terminal of the reference example shown in FIGS. 1 to 8. FIG. 28 is a view showing a seal member in a tenth modified example of the crimp terminal of the reference example shown in FIGS. 1 to 8.

In the seal member 44*a* of the seventh modification shown in FIG. 25, the first seal portion 441*a* and the second seal portion 442*a* are divided, and a space G41*a* in the cross direction D 12 is opened. On the other hand, the first seal portion 441*a* and the third seal portion 443*a* are connected to each other, and both are formed in an L shape in plan view. In other words, the seal member 44*a* is in a two-divided state. At the time of crimping, the second seal portion 442*a* is extended in the cross direction D12. Due to this extension, the second seal portion 442*a* is connected to the first seal portion 441*a*, and the space G41*a* is blocked.

In the seal member 44 *b* in the eighth modification shown in FIG. 26, the first seal portion 441*b* and the second seal portion 442*b* are divided and the space G41*b* in the axial direction D11 is opened. On the other hand, the first seal portion 441*b* and the third seal portion 443*b* are connected to each other, and both are formed in an L shape in a plan view. At the time of crimping, the first seal portion 441*b* is extended in the axial direction D11. Due to this extension, the first seal portion 441*b* is connected to the second seal portion 442*b*, and the space G 41 *b* is blocked.

In the seal member 44*c* in the ninth modification shown in FIG. 27, the first seal portion 441*c* and the third seal portion 443*c* are divided, and the space G41*c* in the cross direction D12 is opened. On the other hand, the first seal portion 441*c* and the second seal portion 442*c* are connected to each other, and both are formed in an inverted L shape in a plan view. At the time of crimping, the third seal portion 443*c* is extended in the cross direction D12. As a result of this extension, the third seal portion 443*c* is connected to the first seal portion 441*c*, and the space G41*c* is blocked.

In the seal member 44*d* in the tenth modification shown in FIG. 28, the first seal portion 441*d* and the third seal portion 443*d* are divided and the space G41 *d* in the axial direction D11 is opened. On the other hand, the first seal portion 441*d* and the second seal portion 442*d* are connected to each other, and both are formed in an inverted L shape in plan view. At the time of crimping, the first seal portion 441*d* is extended in the axial direction D11. Due to this extension, the first seal portion 441*d* is connected to the third seal portion 443*d*, and the space G41*d* is blocked.

This concludes the explanation including the modified example of the reference example, and the embodiment will be described together with the modification thereof. In the embodiment, a plurality of recesses provided in the inner surface of the barrel portion is different from those in the reference example. Hereinafter, the embodiment will be described focusing on differences from the reference example.

Figure 29:
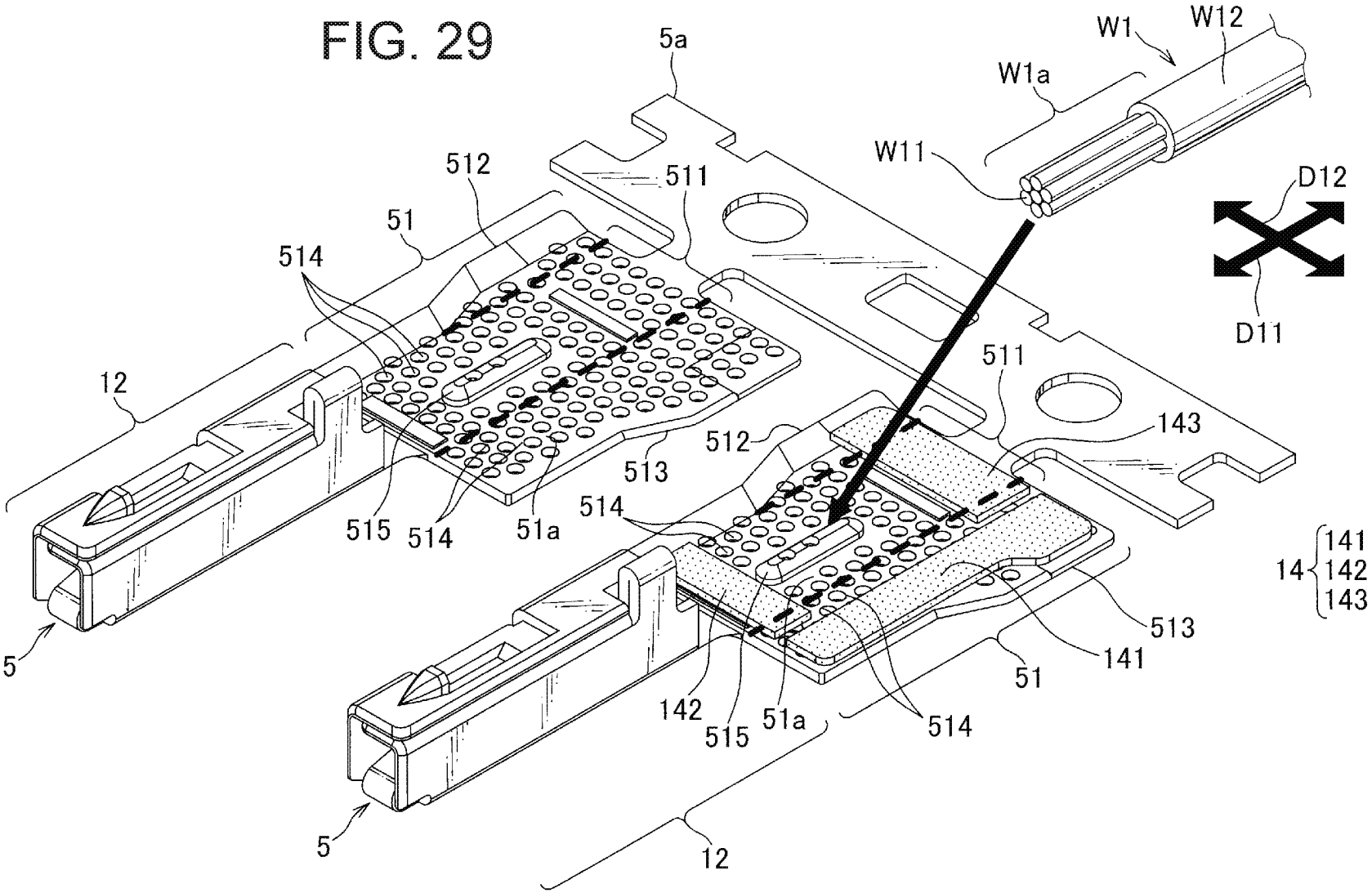
FIG. 29 is a view for explaining a crimp terminal according to an embodiment of the present invention.
Figure 30:
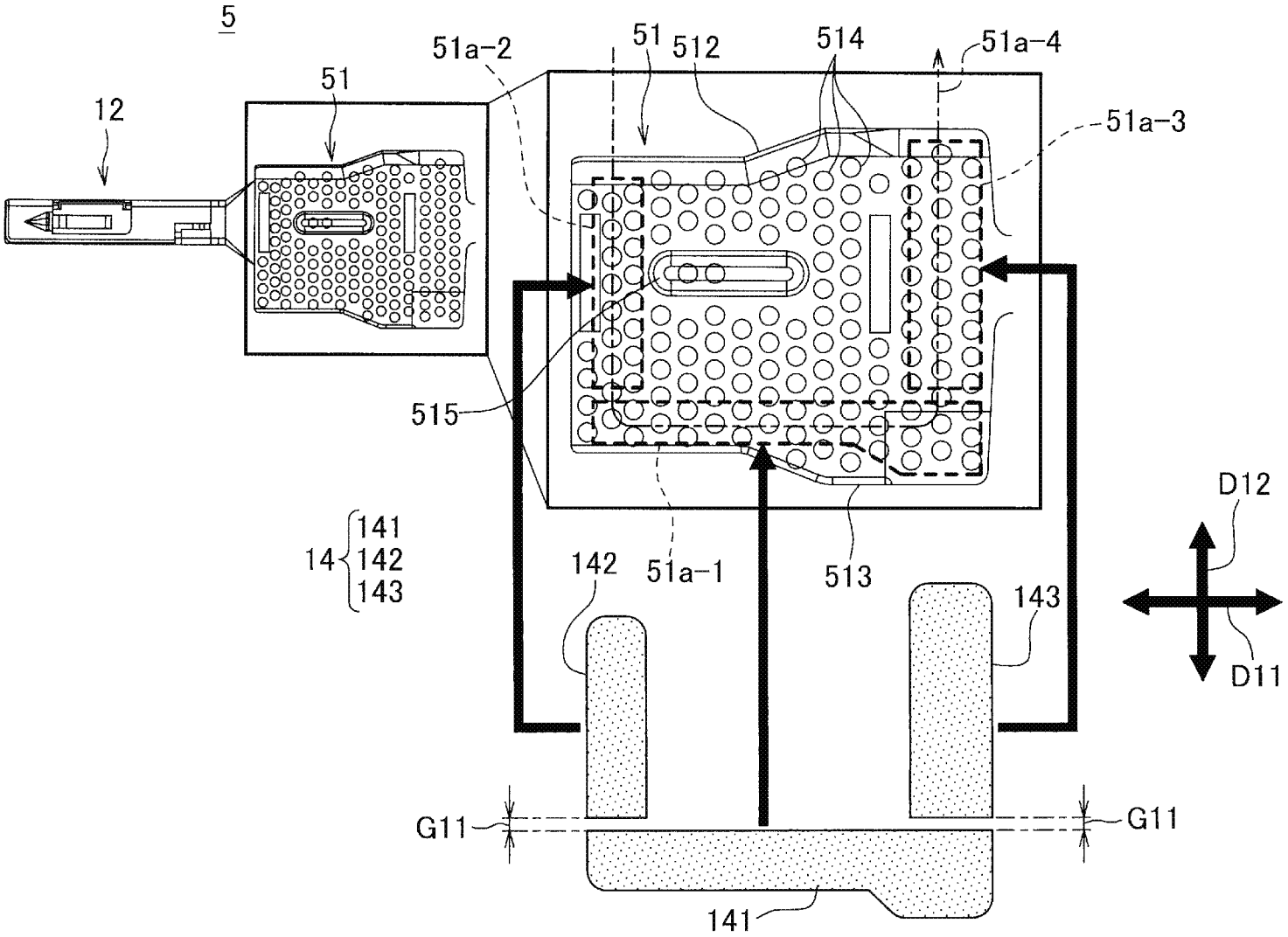
FIG. 30 is a schematic view showing how the seal member shown in FIG. 29 is stuck to the inner surface of the barrel portion.

FIG. 29 is a view for explaining a crimp terminal according to an embodiment of the present invention. FIG. 30 is a schematic view showing how the seal member shown in FIG. 29 is attached to the inner surface of the barrel portion. In FIG. 29 and FIG. 30, the same reference numerals as those in FIG. 1 to FIG. 8 are attached to the same elements as those shown in FIGS. 1 to 8, and in the following description, the duplicate explanation of the elements will be omitted. Also in FIG. 29, two crimp terminals 5 are shown, but one crimp terminal 5 is shown with the seal member 14 removed so that the inner surface shape of the barrel portion 51 can be seen.

In the crimp terminal 5 according to the present embodiment, the inner surface 51*a* of the barrel portion 51 is dispersedly provided with a plurality of recesses 514 extending over substantially the entire region including the first region 51*a*-1, the second region 51*a*-2 and the third region 51*a*-3. On the inner surface 51*a*, a projection 515 is also formed by press working from the outer surface side at a position where the aluminum core wire W11 is placed. The first region 51*a*-1 is a region that traverses the outer barrel piece 513 in the axial direction D11. The second region 51*a*-2 is a region closer to the terminal portion 12 than the aluminum core wire W11, that crosses the inner surface 51*a* of the barrel portion 51 including the bottom plate portion 511 in the intersecting direction D12 between the inner barrel piece 512 side and the outer barrel piece 513 side. The third region 51*a*-3 is a region that traverses the inner surface 51*a* between the inner barrel piece 512 side and the outer barrel piece 513 side in the intersecting direction D12 as crossing the covering portion W12 of the end W1*a*.

Then, the seal member 14 composed of the first seal portion 141, the second seal portion 142, and the third seal portion 143 is attached so that the first region 51*a*-1, the second region 51*a*-2, and the third region 51*a*-3 respectively overlap with the recesses 514. In the second seal portion 142 and the third seal portion 143, between the first seal portion 141 and the second seal portion 141, spaces G11 are opened traversing the path 51*a*-4 from the second region 51*a*-2 to the third region 51*a*-3 via the first region 51*a*-4 in the axial direction D11.

The crimp terminal 5 described above is manufactured by the following terminal manufacturing method.

In this terminal manufacturing method, first, a sheet metal working step of forming a structure before attachment of the seal member 14 is performed. In the sheet metal working step, the barrel portion 51 is formed of a metal plate together with the terminal portion 12. Also in this embodiment, in this sheet metal working step, the barrel portion 51 and the terminal portion 12 are collectively formed in a state in which a plurality of crimp terminals 5 is connected by a strip-like connecting piece 5*a*. In this sheet metal working step, the plurality of recesses 514 and the projections 515 on the inner surface 51*a* of the barrel portion 51 are also formed.

Subsequently, a seal member sticking step is carried out for forming the seal member 14 with an adhesive gel sheet, and for sticking the seal member 14 over the first area 51*a*-1, the second area 51*a*-2, and the third area 51*a*-3. This seal member sticking step is the one of sticking the seal member 14 in a state of being divided in the middle of the above-mentioned path 51*a*-4. That is, the first seal portion 141, the second seal portion 142, and the third seal portion 143 are individually affixed to the inner surface 51*a* of the barrel portion 51.

Also in the seal member sticking step in the present embodiment, the first seal portion 141, the second seal portion 142, and the third seal portion 143 are removed from the adhesive gel sheet in the same manner as in the above-described reference example, and is attached to the inner surface 51*a* of the barrel portion 51.

The crimp terminal 5 manufactured in this manner is crimped to the end portion W1*a* of the covered electric wire W1 as follows.

Figure 31:
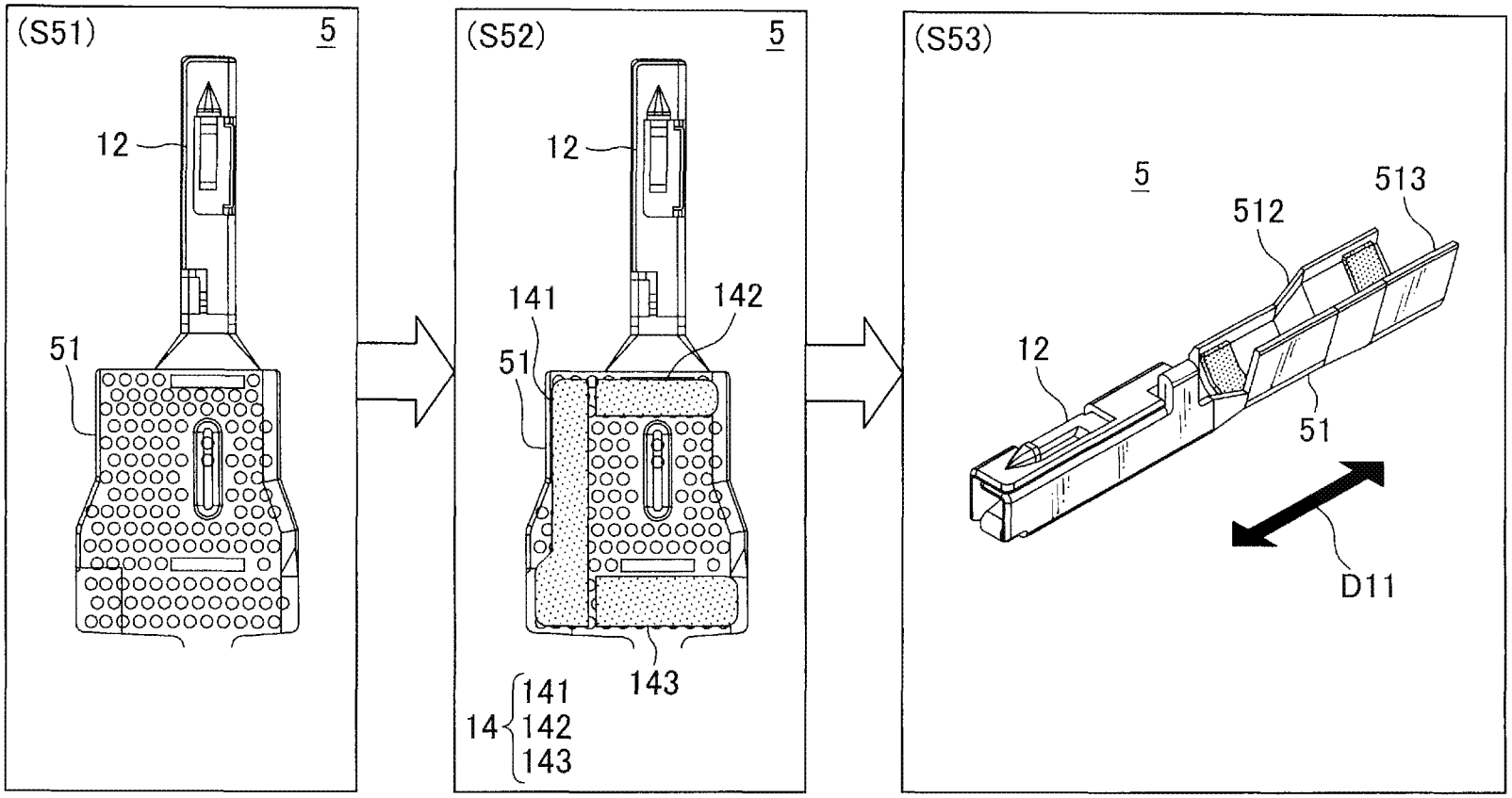
FIG. 31 is a view showing a procedure until the preparation for crimping to the end portion of the covered electric wire is completed in the crimp terminal shown in FIGS. 29 and 30.
Figure 32:
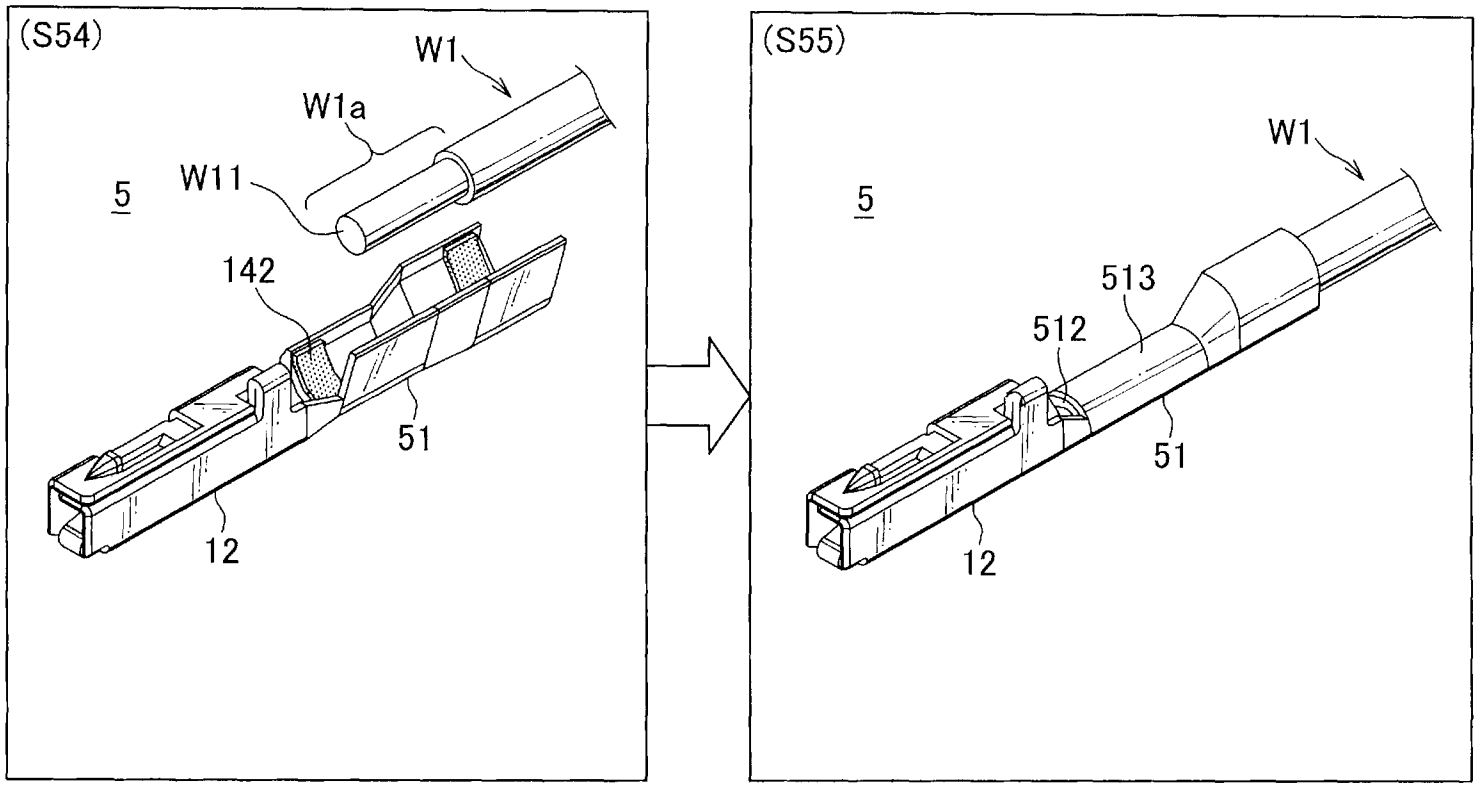
FIG. 32 is a view showing a procedure until the crimp terminal is crimped to the end portion of the covered electric wire following the procedure shown in FIG. 31.

FIG. 31 is a view showing the procedure up to the completion of preparation for crimping the crimp terminal shown in FIGS. 29 and 30 on the end portion of the covered electric wire, and FIG. 32 is a view showing the procedure until the crimp terminal is crimped to the end portion of the covered electric wire following the procedure of FIG. 31.

FIG. 31 also shows a sheet metal working step (S51) and a seal member sticking step (S52) in the terminal manufacturing method described above. In the sheet metal working step (S51), the barrel part 51 and the terminal part 12 are formed, and in the seal member sticking step (S52), the first sealing part 141, the second sealing part 142, and the third sealing part 143 forming the seal member is affixed.

In crimping to the end portion W1*a* of the covered electric wire W1, first, the crimp terminal 5 to be crimped is separated from the joining portion 5*a* shown in FIG. 29. Then, the barrel portion 51 is subjected to bending deformation as preparation for placing the end portion W1*a* of the covered electric wire W1 (S53). This bending deformation is performed such that the inner barrel piece 512 and the outer barrel piece 513 are brought close to each other so that the cross section intersecting with the axial direction D11 is substantially U-shaped.

Subsequently, the end portion W1*a* of the covered electric wire W1 is placed on the barrel portion 51 after the bending deformation (S54). At this time, the end portion W1*a* is placed so that the tip of the aluminum core wire W11 does not overlap with the second seal portion 142. It is noted that overlapping of the leading end of the aluminum core wire W11 and the second seal portion 142 are permitted to some extent. Subsequently, the barrel portion 51 is wound around and crimped to the end portion W1*a* so that the outer barrel piece 513 is overlapped with the inner barrel piece 512 facing inward (S55).

By such crimping, the seal member 14 seals the various portions of the crimp terminal 5 as follows.

Figure 33:
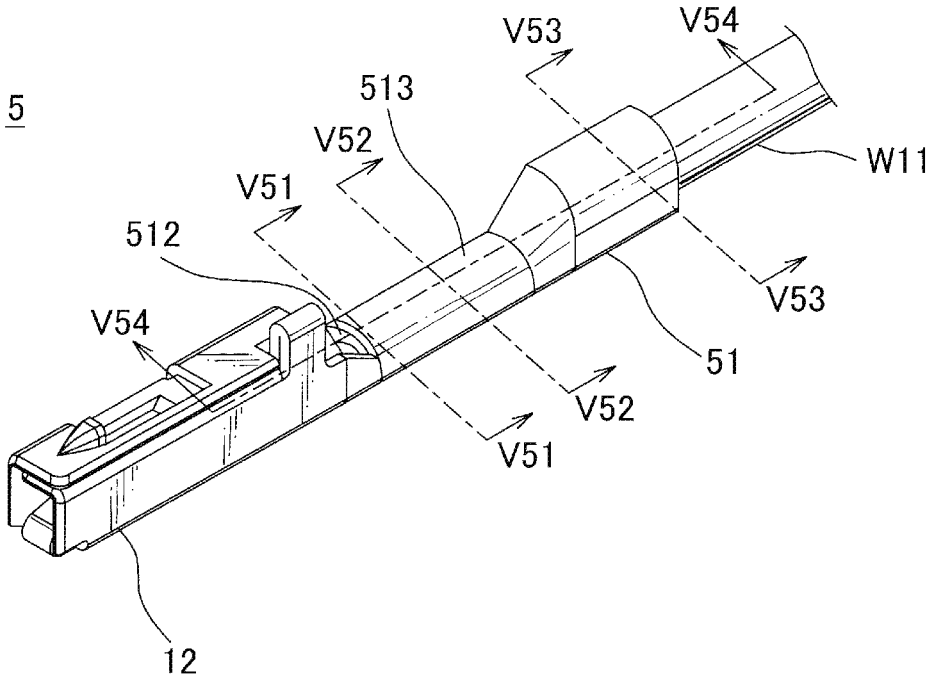
FIG. 33 is a view showing a crimp terminal after crimping also shown in FIG. 32.
Figure 34:
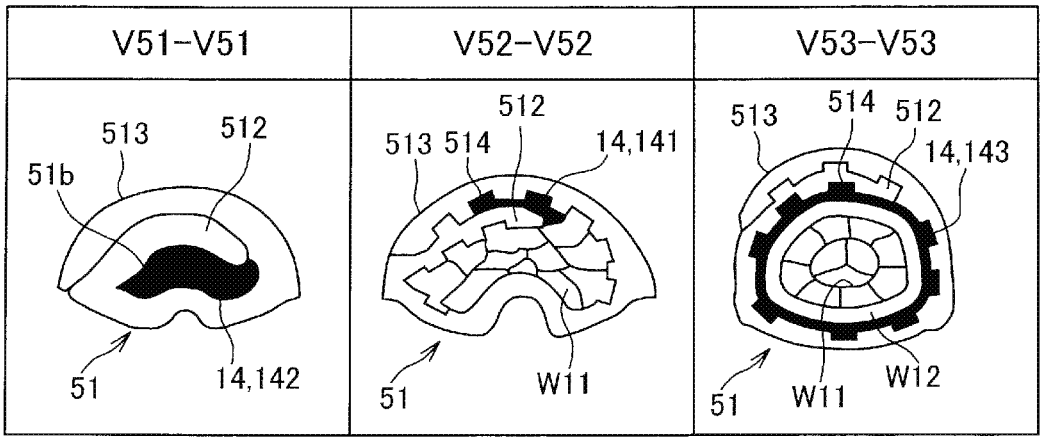
FIG. 34 is a view showing a cross section taken along line V51-V51, a cross section taken along line V52-V52, and a cross section taken along line V53-V53 in FIG. 33.
Figure 35:
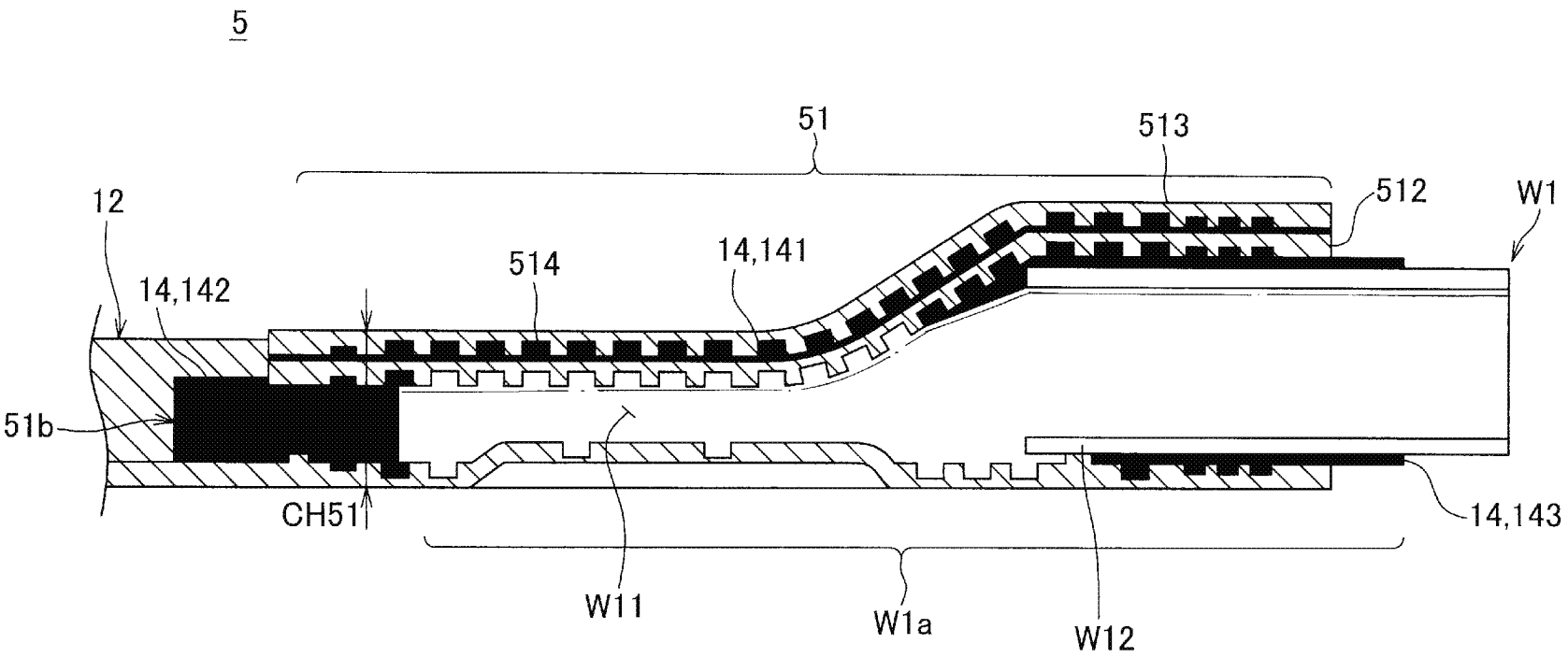
FIG. 35 is a cross-sectional view taken along the line V54-V54 in FIG. 33.

FIG. 33 is a view showing a crimp terminal after crimping also shown in FIG. 32. FIG. 34 is a view showing a cross section taken along the line V51-V51, a cross section taken along the line V52-V52, and a cross section taken along the line V53-V53 in FIG. 33. Further, FIG. 35 is a view showing a cross section taken along the line V54-V54 in FIG. 33.

In the present embodiment, the recesses 514 overlapping the seal member 14 play a role of the groove portion 116 in the reference example. During the crimping, a movement of the seal member 14 due to a pressure applied at the time of crimping is suppressed by the recesses 514 overlapping with the seal member 14. The spaces G11 between the second seal portion 142 and the third seal portion 143 of the seal member 14, and the first seal portion 141 are connected due to extension in the intersecting direction D11 of the second seal portion 142 and the third seal portion 143. After crimping, the space between the inner barrel piece 512 and the outer barrel piece 513 is sealed with the first seal member 141 of the seal member 14. In addition, the opening 51*b* of the tubular barrel portion 51 on the terminal portion 12 side is sealed with the second seal portion 142, and the space between the covering portion W12 and the barrel portion 51 is sealed with the third seal portion 143.

A crimp height CH51 of the barrel portion 51 after crimping is set to such a size that the tubular barrel portion 51 is crushed to such an extent that a part of the seal member 14 protrudes from the opening 51*b* of the barrel portion 51. As a result, the opening 51*b* of the barrel portion 51 is sealed at a high level. A part of the seal member 14 also protrudes from between the covering portion W12 and the barrel portion 51 even on the extending side of the covered electric wire W1 in the barrel portion 51 to seal the portion at a high level. The dimensions such as the width of each portion of the first seal portion 141, the second seal portion 142, and the third seal portion 143 forming the seal member 14 are formed to have dimensions necessary and sufficient for such sealing after crimping. Further, by sealing the opening 51*b* of the barrel 51 or protruding of the seal member 14 from the opposite side thereof allows for visually checking the sealing at those portions.

In the crimp terminal 5 of the embodiment described above, the edges of the recesses 514 provided on the inner surface 51*a* of the barrel portion 51 bite into the aluminum core wire W11 by crimping so that satisfactory conduction is obtained between the covered wire W1 and the crimp terminal 5. The part of the plurality of recesses 514 provided on the inner surface of the barrel portion 51 overlaps with the seal member 14 for securing waterproofness against a contact portion with the aluminum core wire W11. Therefore, it is possible to utilize the recesses 514 at the position overlapping the seal member 14 as a mark for providing the seal member 14 on the inner surface 51*a* of the barrel portion 51, and it is also possible to alleviate the difficulty in manufacturing in this point. In addition, the recesses 514 overlapping the seal member 14 suppress the movement of the seal member 14 due to the pressure applied at the time of crimping, thereby contributing to ensuring a higher level of waterproofness. As described above, according to the crimp terminal 5 of the present embodiment, utilizing the part of the recess 514 provided for good conduction between the covered electric wire W1 and the crimp terminal 5 while securing the waterproof property against the contact portion with the aluminum core wire W 11 can alleviate difficulties in manufacturing.

Further, according to the crimp terminal 5 of the present embodiment, since the inner surface shape of the barrel portion 51 is simplified such that the plurality of recesses 514 is distributed over substantially the entire area, it is possible to further alleviate the manufacturing difficulty with respect to the molding of the barrel portion 51. In addition, when providing the seal member 14, if the seal member 14 is provided along the outer periphery of the barrel portion 51, even if the seal member 14 is somewhat inclined or the like, the seal member 14 and the recess 514 can be provided so as to overlap each other. That is, since a high positional accuracy is unnecessary when providing the seal member 14, it is possible to further alleviate manufacturing difficulty even in this respect.

Next, as a modified example of the crimp terminal 5 of the embodiment, modification examples of the manner of attachment and shape of the seal member 14 to be attached to the barrel portion 51 will be described.

Figure 36:
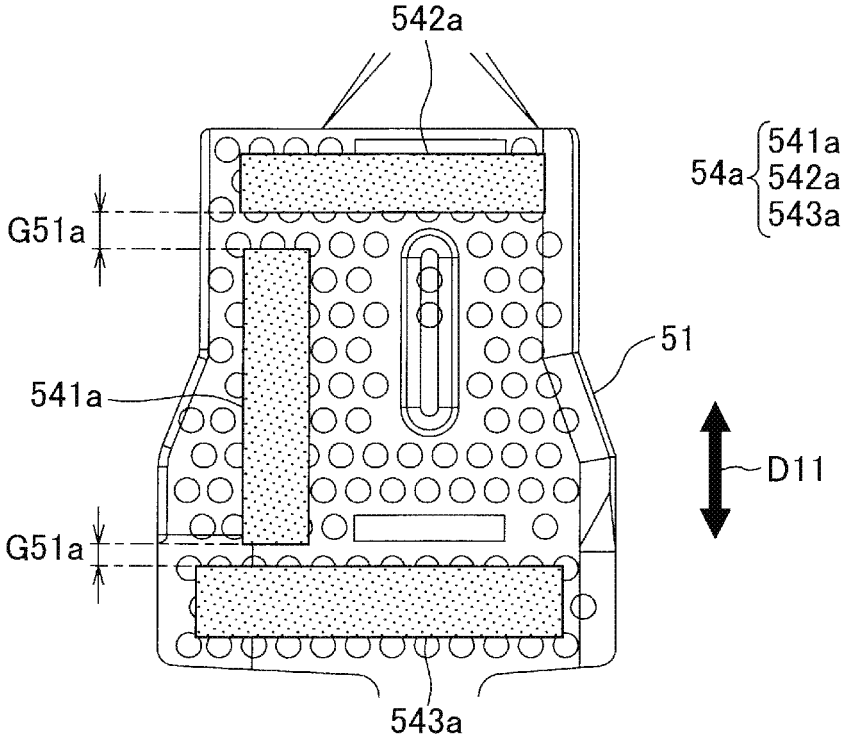
FIG. 36 is a view showing a seal member in a first modification of the crimp terminal of the embodiment shown in FIGS. 29 to 35.
Figure 37:
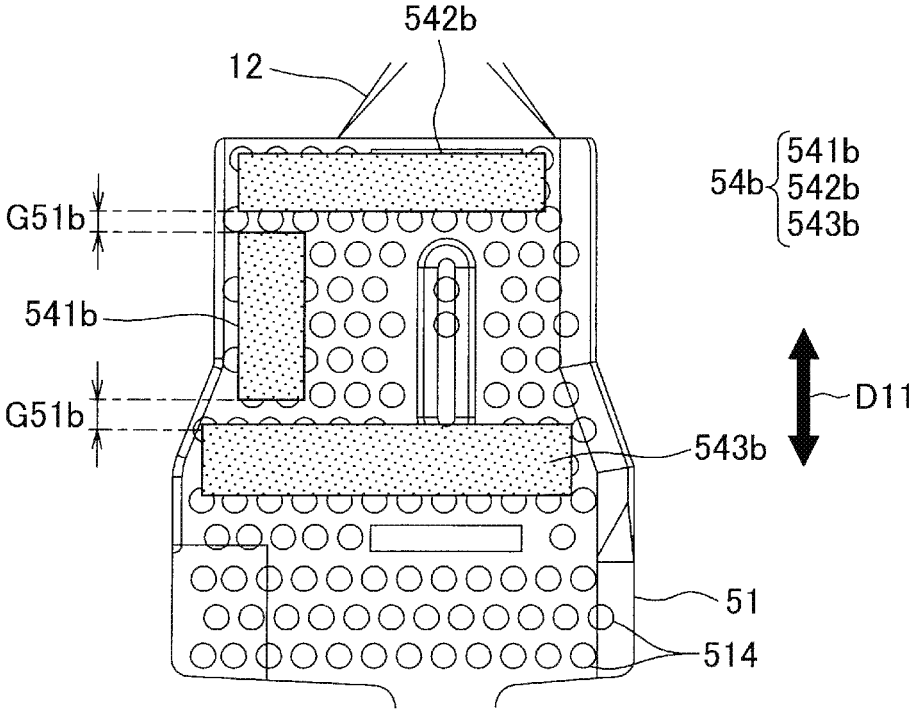
FIG. 37 is a view showing a seal member according to a second modification of the crimp terminal of the embodiment shown in FIGS. 29 to 35.
Figure 38:
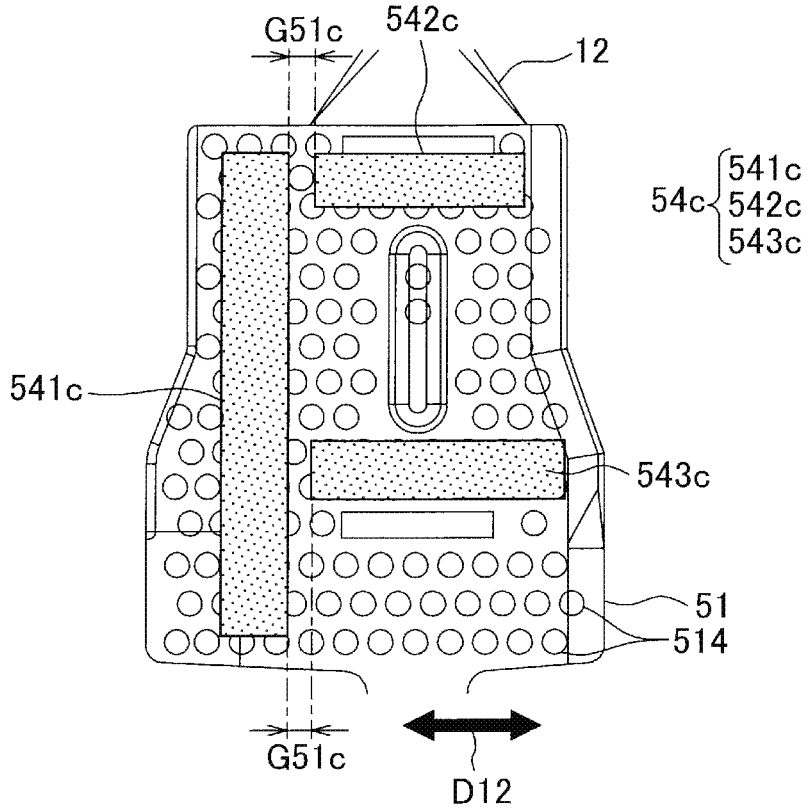
FIG. 38 is a view showing a seal member in a third modification to the crimp terminal of the embodiment shown in FIGS. 29 to 35.
Figure 39:
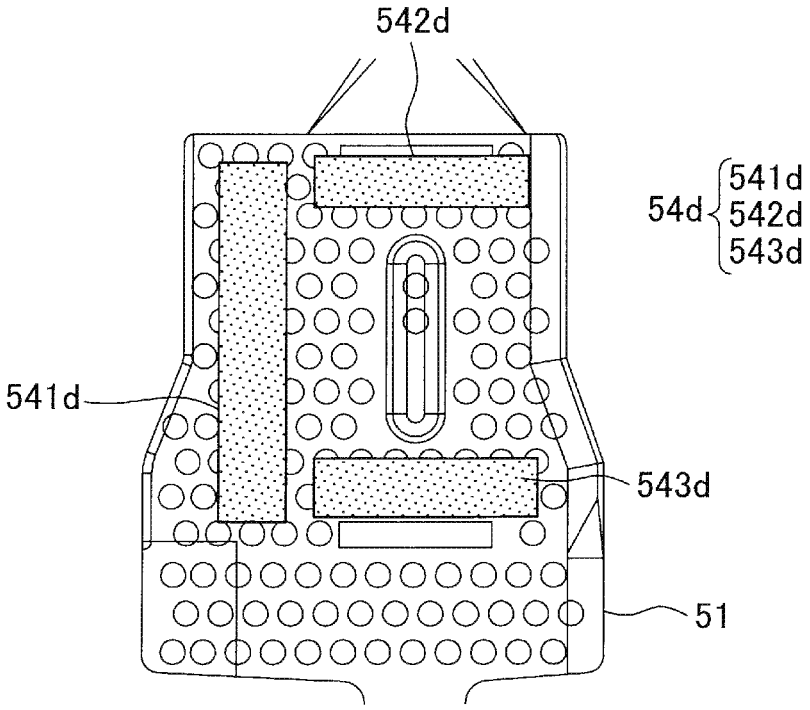
FIG. 39 is a view showing a seal member according to a fourth modification of the crimp terminal of the embodiment shown in FIGS. 29 to 35.
Figure 40:
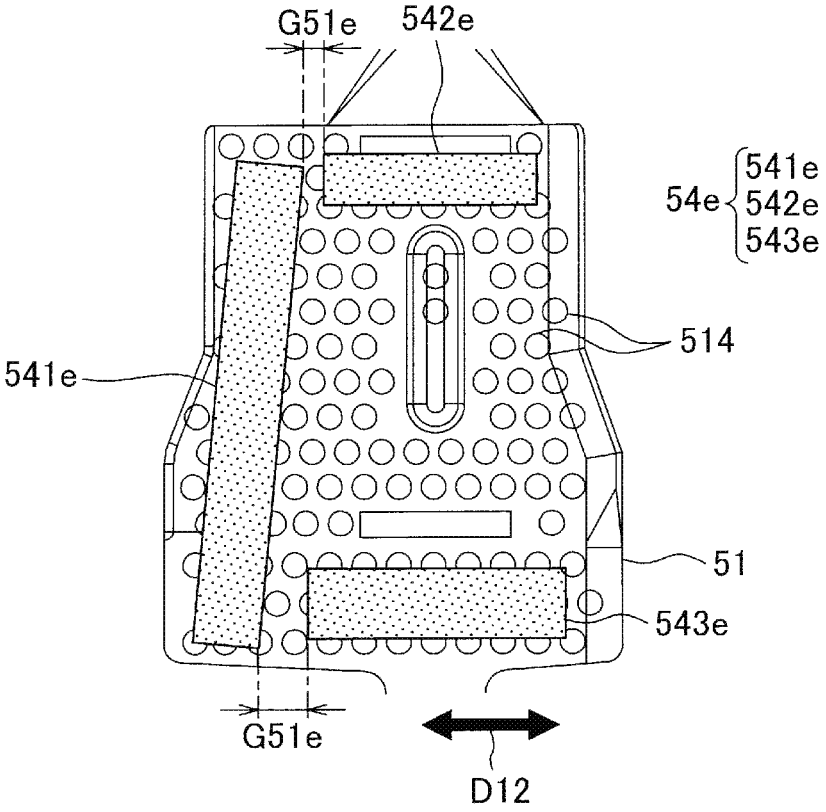
FIG. 40 is a view showing a seal member in a fifth modification to the crimp terminal of the embodiment shown in FIGS. 29 to 35.
Figure 41:
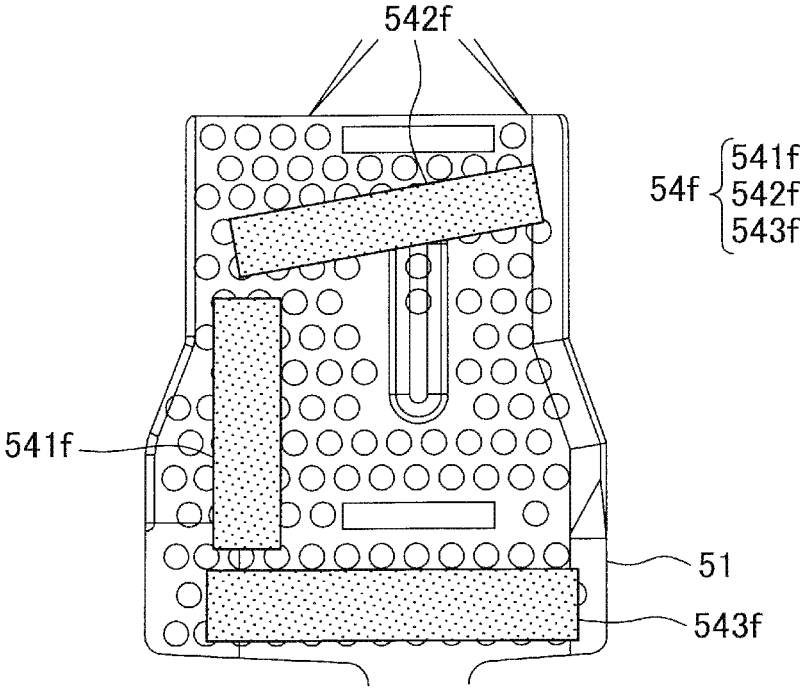
FIG. 41 is a view showing a seal member in a sixth modification to the crimp terminal of the embodiment shown in FIGS. 29 to 35.
Figure 42:
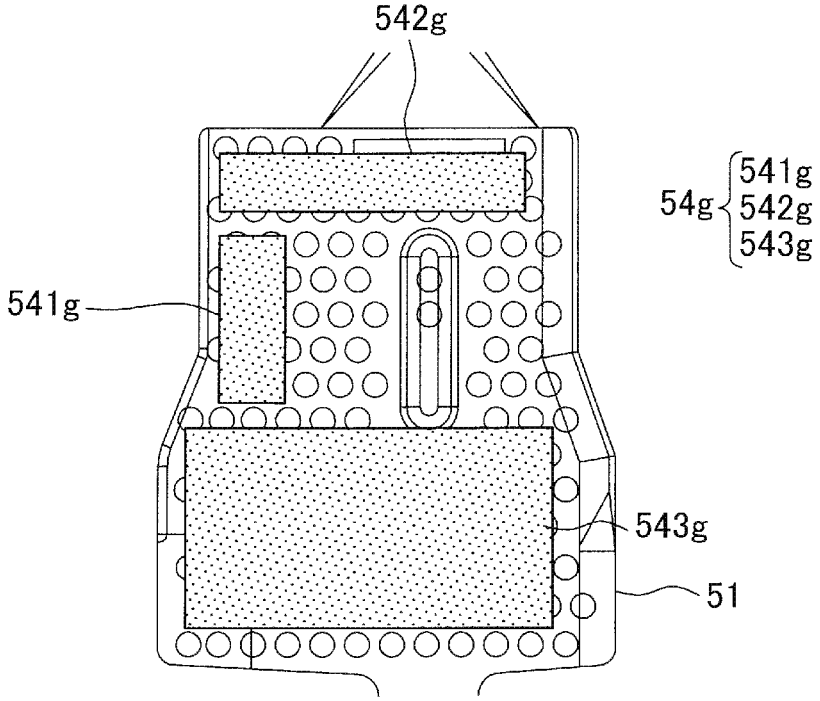
FIG. 42 is a view showing a seal member according to a seventh modification of the crimp terminal of the embodiment shown in FIGS. 29 to 35.

FIG. 36 is a view showing a seal member in the first modification to the crimp terminal of the embodiment shown in FIGS. 29 to 35. FIG. 37 is a view showing a seal member according to a second modification of the crimp terminal of the embodiment shown in FIGS. 29 to 35. FIG. 38 is a view showing a seal member in a third modification of the crimp terminal of the embodiment shown in FIGS. 29 to 35. FIG. 39 is a view showing a seal member in a fourth modification of the crimp terminal of the embodiment shown in FIGS. 29 to 35. FIG. 40 is a view showing a seal member in a fifth modification to the crimp terminal of the embodiment shown in FIGS. 29 to 35. FIG. 41 is a view showing a seal member in a sixth modification to the crimp terminal of the embodiment shown in FIGS. 29 to 35. FIG. 42 is a view showing a seal member in a seventh modification example of the crimp terminal of the embodiment shown in FIGS. 29 to 35.

In the seal member 54*a* of the first modification shown in FIG. 36, spaces G51*a* in the axial direction D11 are opened between the second seal portion 542*a* and the third seal portion 543*a*, and the first seal portion 541*a*. In this first modification, at the time of crimping, the first seal portion 541*a* extends in the axial direction D11 to close the space G51*a*, thereby securing a high level of waterproofness.

In the seal member 54*b* in the second modification shown in FIG. 37, the first seal portion 541*b* is formed to be short, and the entire seal member 54*b* is located at a position biased toward the terminal portion 12 as compared with the first modification. Also in the second modification, spaces G51*b* in the axial direction D11 are opened between the second seal portion 542*b* and the third seal portion 543*b*, and the first seal portion 541*b*, and the spaces G51*b* are blocked by the extension at the time of crimping. In this second modified example, although the region sealed by the seal member 54*b* becomes narrow, it is prerequisite that the attachment position is set to a position where waterproofness is obtained against the contact portion between the aluminum core wire W11 and the barrel portion 51. In the second modification, the sticking position of the seal member 54*b* is set on the basis of the degree of freedom of the sticking position due to the fact that the recesses 514 are formed on substantially the entire surface of the barrel portion 51. According to the second modified example, the amount of the adhesive gel sheet used can be suppressed by a reduction in the length of the first seal portion 541*b*, so that the cost can be reduced.

In the seal member 54*c* of the third modification shown in FIG. 38, spaces G51*c* in the cross direction D12 are opened between the second seal portion 542*c* and the third seal portion 543*c*, and the first seal portion 541*c*. The second seal portion 542*c* and the third seal portion 543*c* extend in the intersecting direction D12 during crimping to close the spaces G51*c*. Further, in the third modification, based on the degree of freedom of the affixing position due to the formation of the recess 514 on substantially the entire surface of the barrel portion 51, the affixing position of the third seal portion 543*c* is shifted close to the terminal portion 12.

The seal member 54*d* in the fourth modification shown in FIG. 39 is a modification of the third modification described above, in which the first seal portion 541*d* is shortened, the second seal portion 542*d* and the third seal portion 543 *d* is set to substantially the same length.

In the seal member 54*e* of the fifth modification shown in FIG. 40, spaces G51*e* in the cross direction D12 are opened between the second seal portion 542*e* and the third seal portion 543*e*, and the first seal portion 541*e*. The second seal portion 542*e* and the third seal portion 543*e* are extended in the intersecting direction D12 at the time of crimping to close the spaces G51*e*. In the fifth modified example, on the basis of the degree of freedom of the affixing position due to the formation of the recess 514 on substantially the entire surface of the barrel portion 51, the first sealing portion 541*e* is tilted and attached.

The seal member 54*f* in the sixth modification shown in FIG. 41 is a modification of the first modification shown in FIG. 36, in which the first seal portion 541*f* is shortened. In the sixth modified example, on the basis of the degree of freedom of the affixing position due to the formation of the recess 514 on substantially the entire surface of the barrel portion 51, the second sealing portion 542*f* is tilted and attached. The third seal portion 543*f* is equivalent to the first modification example of FIG. 36.

The seal member 54*g* in the seventh modification shown in FIG. 42 is also a modification of the first modification shown in FIG. 36. In this seventh modified example, the first seal portion 541*g* is shortened and the second seal portion 542*g* is elongated. In addition, the third seal portion 543*g* is formed wider as well as becomes longer.

As described above, in the crimp terminal 5 of the embodiment, the recess 514 is formed on substantially the entire surface of the barrel portion 51 as described in various modifications, so that it is possible to appropriately set with degrees of freedom the attachment manner and shape of the seal member.

Subsequently, a further modified example of the crimp terminal 5 of the embodiment will be described.

Figure 43:
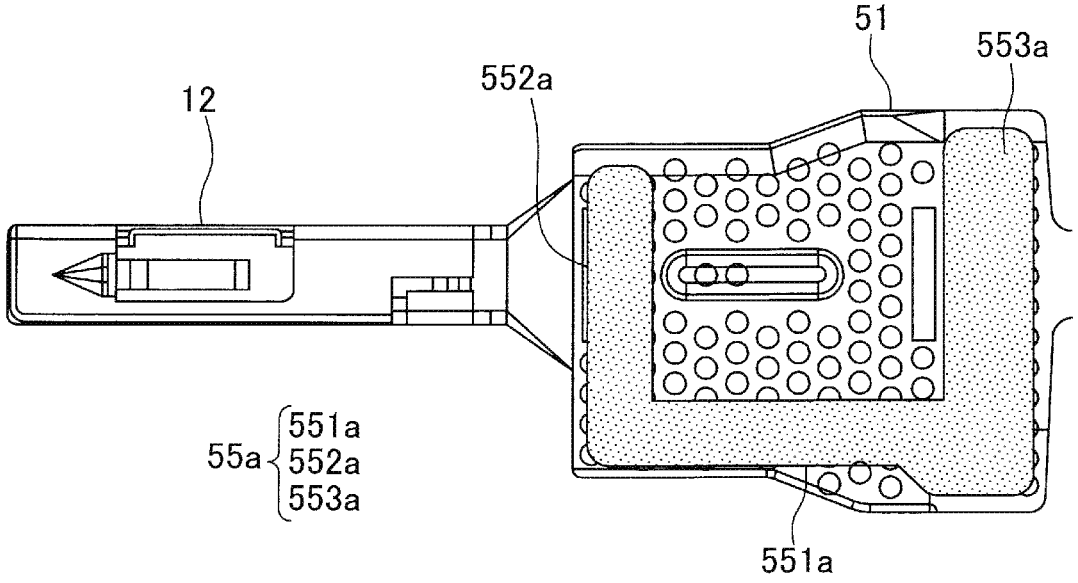
FIG. 43 is a view showing a seal member according to an eighth modification of the crimp terminal of the embodiment shown in FIGS. 29 to 35.
Figure 44:
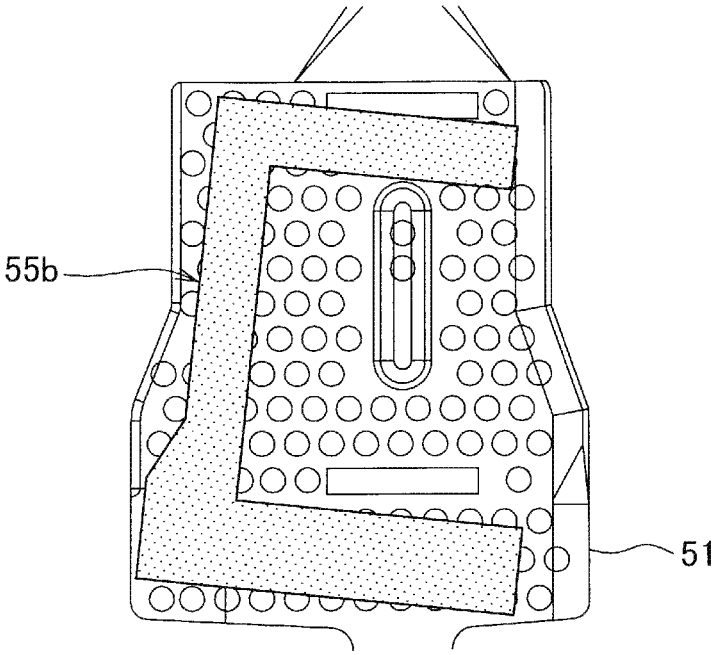
FIG. 44 is a view showing a seal member according to a ninth modification of the crimp terminal of the embodiment shown in FIGS. 29 to 35.
Figure 45:
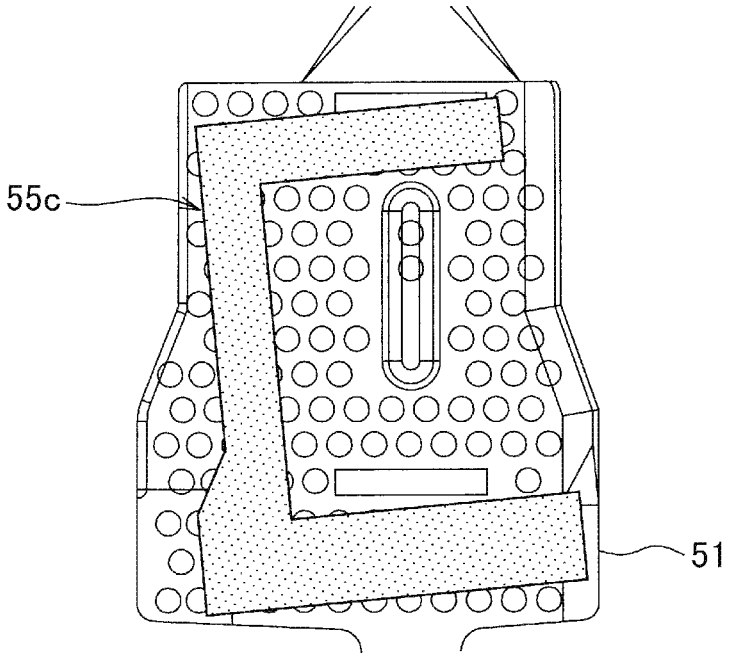
FIG. 45 is a view showing a seal member in a tenth modified example of the crimp terminal of the embodiment shown in FIGS. 29 to 35.
Figure 46:
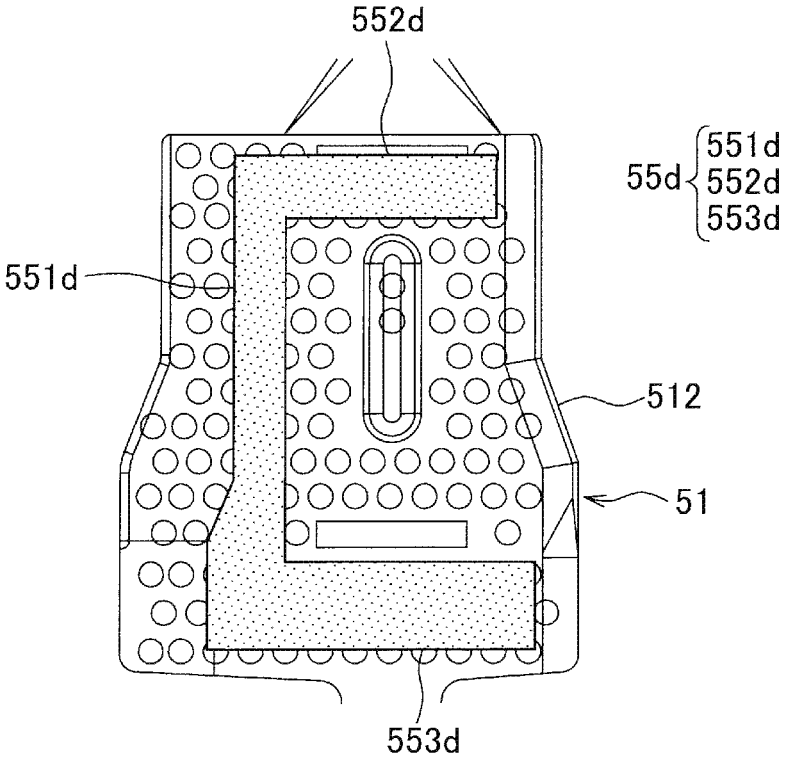
FIG. 46 is a view showing a seal member according to an eleventh modification of the crimp terminal of the embodiment shown in FIGS. 29 to 35.
Figure 47:
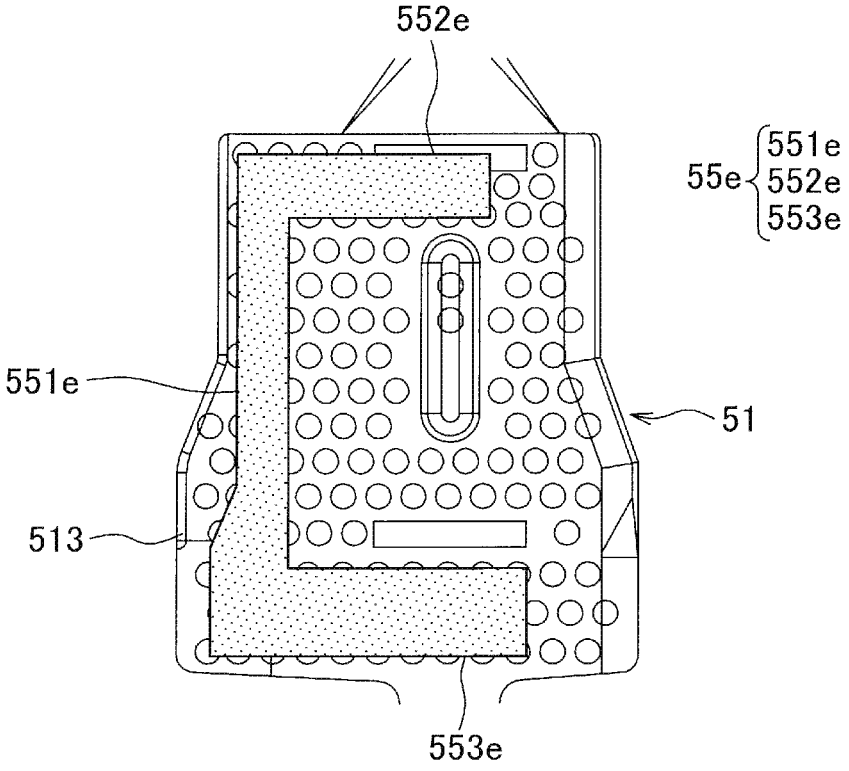
FIG. 47 is a view showing a seal member in a twelfth modification of the crimp terminal of the embodiment shown in FIGS. 29 to 35.
Figure 48:
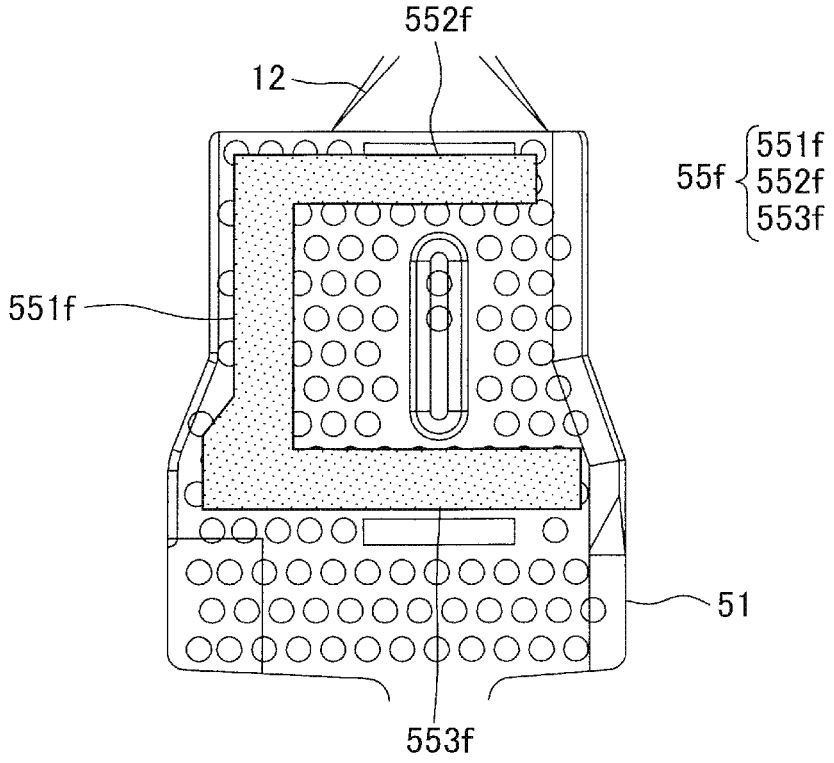
FIG. 48 is a view showing a seal member in a thirteenth modified example of the crimp terminal of the embodiment shown in FIGS. 29 to 35.

FIG. 43 is a view showing a seal member in an eighth modification of the crimp terminal of the embodiment shown in FIGS. 29 to 35. FIG. 44 is a view showing a seal member in a ninth modification to the crimp terminal of the embodiment shown in FIGS. 29 to 35. FIG. 45 is a view showing a sealing member in a tenth modified example of the crimp terminal of the embodiment shown in FIGS. 29 to 35. FIG. 46 is a view showing a seal member according to an eleventh modification of the crimp terminal of the embodiment shown in FIGS. 29 to 35. FIG. 47 is a view showing a seal member in a twelfth modification of the crimp terminal of the embodiment shown in FIGS. 29 to 35. FIG. 48 is a view showing a seal member in a thirteenth modified example of the crimp terminal of the embodiment shown in FIGS. 29 to 35.

The seal member 55*a* in the eighth modification shown in FIG. 43 is not divided and is formed in a C shape connected integrally in a plan view such that the second seal portion 552*a* and the third seal portion 553*a* extend from the first seal portion 551*a* into two arms.

Each of the modifications shown in FIGS. 44 to 47 described below is a modification of the eighth modification described above.

The sealing member 55*b* in the ninth modification shown in FIG. 44 has a C-shaped seal member 55*b* in plan view and is attached to the barrel portion 51 in a state of being inclined clockwise in FIG. 44.

The seal member 55*c* in the tenth modification shown in FIG. 45 has a C-shaped seal member 55*c* in plan view and is attached to the barrel portion 51 in a state of being inclined counterclockwise in FIG. 45.

The seal member 55*d* in the eleventh modification shown in FIG. 46 is obtained by connecting the short second seal portion 552*d* and the third seal portion 553*d* with the first seal portion 551*d*. In the eleventh modified example, the seal member 55*d* as a whole is affixed in a state biased toward the inner barrel piece 512 of the barrel portion 51.

The seal member 55*e* in the twelfth modification shown in FIG. 47 is also formed by connecting the second seal portion 552*e* and the third seal portion 553*e*, which are formed short, with the first seal portion 551*e*. However, in the twelfth modified example, the seal member 55*e* as a whole is affixed in a state biased toward the outer barrel piece 513 of the barrel portion 51.

The seal member 55*f* in the thirteenth modification shown in FIG. 48 is formed by connecting the second seal portion 552*f* and the third seal portion 553*f* with the short first seal portion 551*f*. In the thirteenth modified example, the seal member 55*f* as a whole is affixed in a state biased toward the terminal portion 12 of the barrel portion 51.

As described above in various modified examples, in the crimp terminal 5 of the embodiment, even when the integral seal member is used, since the recess 514 is formed on substantially the entire surface of the barrel portion 51, it is possible to appropriately set the attachment method and shape thereof with high degree of freedom.

It is to be noted that the above-described embodiment merely shows a representative form of the present invention, and the present invention is not limited to this embodiment. That is, various modifications can be made without departing from the gist of the present invention. As long as the configuration of the present invention is still provided by such a deformation, it is of course within the scope of the present invention.

For example, in the above-described embodiment and various modified examples, a mode in which a projection is provided on the barrel portion by press working from the outer surface side is exemplified. However, the barrel portion is not limited to this form, and the projection may be omitted. However, as described above, providing the projections makes it possible to spread strands of the aluminum core wire and increase the number of contacts with the barrel portion.

In each of the above-described embodiments and various modified examples, a crimp terminal having a terminal portion 12 as a female terminal in a square tubular shape is exemplified as one example of a terminal portion. However, the terminal portion is not limited to this, and it does not require any specific shape or connection mode.

REFERENCE SIGNS LIST

1, 5 crimp terminal 11
51 barrel portion
11 *a*, 51*a* inner surface
11*a*-1, 51*a*-1 first region
11*a*-2, 51*a*-2 second region
11*a*-3, 51*a*-3 third region
11*a*-4, 51*a*-4 path
12 terminal portion
14 sealing member
111, 511 bottom plate portion
112, 512 inside barrel piece
113, 51 outer barrel piece
114, 514 recessed portion
115, 515 protruding portion
116 groove portion
141 first sealed portion
142 second sealed portion
143 third seal portion
D11 axial direction
D12 cross direction
G11 space
W1 covered electric wire
W1*a* end portion
W11 aluminum core wire
W12 covered portion

What is claimed is:

1. A crimp terminal, comprising:

a barrel portion windable around and crimpable to an end portion of a covered electric wire having an aluminum core wire, the aluminum core wire being exposed at the end portion, a terminal portion connectable to a connection object; the barrel portion and the terminal portion being arranged in a predetermined axial direction, and the barrel portion including a bottom plate portion extending in the axial direction on which the end portion of the covered electric wire is placed, and an inner barrel piece and an outer barrel piece extending from the bottom plate portion on both sides in a intersecting direction intersecting the axial direction in plan view with respect to the bottom plate portion, and at the time of crimping the barrel portion being wound around the end portion with the inner barrel piece placed inside, and a seal member provided across a first region traversing the outer barrel piece in the axial direction, a second region traversing an inner surface of the barrel portion in the intersecting direction at a position closer to the terminal portion than the aluminum core wire, and a third region traversing the inner surface in the intersecting direction so as to intersect a covered portion of the end portion, and the seal member is configured to, after crimping, seal a space between the inner barrel piece and the outer barrel piece, an opening of the barrel portion formed cylindrical on the terminal portion side, and a space between the covered portion and the barrel portion, wherein a plurality of recesses is dispersedly provided on the inner surface of the barrel portion across the first region, the second region, and the third region so as to partly overlap with the seal member, the seal member includes a first seal portion, a second seal portion, and a third seal portion provided in the first region, the second region, and the third region, respectively, the second seal portion or the third seal portion being a body that is completely separated from the first seal portion with a space between the body and the first seal portion, the plurality of recesses includes central recesses that are dispersedly provided on the inner surface of the barrel portion between the first region, the second region, and the third region such that the central recesses are not overlapped with the seal member, and the central recesses being separated from each other in a direction perpendicular to the axial direction.

2. The crimp terminal according to claim 1, wherein the second seal portion is the body that is completely separated from the first seal portion with the space between the body and the first seal portion.

3. The crimp terminal according to claim 1, wherein the third seal portion is the body that is completely separated from the first seal portion with the space between the body and the first seal portion.

4. The crimp terminal according to claim 1, wherein the second seal portion is a first body that is completely separated from the first seal portion with a first space between the first body and the first seal portion, the third seal portion is a second body that is completely separated from the first seal portion with a second space between the second body and the first seal portion.

5. The crimp terminal according to claim 1, wherein each of the plurality of recesses has an elliptical shape.

6. A crimp terminal, comprising:

a barrel portion windable around and crimpable to an end portion of a covered electric wire having an aluminum core wire, the aluminum core wire being exposed at the end portion, a terminal portion connectable to a connection object; the barrel portion and the terminal portion being arranged in a predetermined axial direction, and the barrel portion including a bottom plate portion extending in the axial direction on which the end portion of the covered electric wire is placed, and an inner barrel piece and an outer barrel piece extending from the bottom plate portion on both sides in a intersecting direction intersecting the axial direction in plan view with respect to the bottom plate portion, and at the time of crimping the barrel portion being wound around the end portion with the inner barrel piece placed inside, and a seal member provided across a first region traversing the outer barrel piece in the axial direction, a second region traversing an inner surface of the barrel portion in the intersecting direction at a position closer to the terminal portion than the aluminum core wire, and a third region traversing the inner surface in the intersecting direction so as to intersect a covered portion of the end portion, and the seal member is configured to, after crimping, seal a space between the inner barrel piece and the outer barrel piece, an opening of the barrel portion formed cylindrical on the terminal portion side, and a space between the covered portion and the barrel portion, wherein a plurality of recesses is dispersedly provided on the inner surface of the barrel portion across the first region, the second region, and the third region so as to partly overlap with the seal member, the seal member includes a first seal portion, a second seal portion, and a third seal portion provided in the first region, the second region, and the third region, respectively, the second seal portion or the third seal portion being a body that is completely separated from the first seal portion with a space between the body and the first seal portion, the plurality of recesses includes a groove that is provided on the inner surface of the barrel portion across the first region, the second region, and the third region so as to overlap with the first seal portion, the second seal portion, and the third seal portion, and the plurality of recesses includes other recesses that are dispersedly provided on the inner surface of the barrel portion across at least two of the first region, the second region, and the third region so as to partly overlap with at least two of the first seal portion, the second seal portion, and the third seal portion.

7. The crimp terminal according to claim 6, wherein the other recesses each have an elliptical shape.

8. A crimp terminal, comprising:

a barrel portion windable around and crimpable to an end portion of a covered electric wire having an aluminum core wire, the aluminum core wire being exposed at the end portion, a terminal portion connectable to a connection object; the barrel portion and the terminal portion being arranged in a predetermined axial direction, and the barrel portion including a bottom plate portion extending in the axial direction on which the end portion of the covered electric wire is placed, and an inner barrel piece and an outer barrel piece extending from the bottom plate portion on both sides in a intersecting direction intersecting the axial direction in plan view with respect to the bottom plate portion, and at the time of crimping the barrel portion being wound around the end portion with the inner barrel piece placed inside, and a seal member provided across a first region traversing the outer barrel piece in the axial direction, a second region traversing an inner surface of the barrel portion in the intersecting direction at a position closer to the terminal portion than the aluminum core wire, and a third region traversing the inner surface in the intersecting direction so as to intersect a covered portion of the end portion, and the seal member is configured to, after crimping, seal a space between the inner barrel piece and the outer barrel piece, an opening of the barrel portion formed cylindrical on the terminal portion side, and a space between the covered portion and the barrel portion, wherein a plurality of recesses is dispersedly provided on the inner surface of the barrel portion across the first region, the second region, and the third region so as to partly overlap with the seal member, the seal member includes a first seal portion, a second seal portion, and a third seal portion provided in the first region, the second region, and the third region, respectively, the second seal portion or the third seal portion being a body that is completely separated from the first seal portion with a space between the body and the first seal portion, the plurality of recesses are dispersedly provided on the inner surface of the barrel portion across the first region, the second region, and the third region so as to partly overlap with the first seal portion, the second seal portion, and the third seal portion, and each of the plurality of recesses has an elliptical shape.

9. A crimp terminal, comprising:

a barrel portion windable around and crimpable to an end portion of a covered electric wire having an aluminum core wire, the aluminum core wire being exposed at the end portion, a terminal portion connectable to a connection object; the barrel portion and the terminal portion being arranged in a predetermined axial direction, and the barrel portion including a bottom plate portion extending in the axial direction on which the end portion of the covered electric wire is placed, and an inner barrel piece and an outer barrel piece extending from the bottom plate portion on both sides in a intersecting direction intersecting the axial direction in plan view with respect to the bottom plate portion, and at the time of crimping the barrel portion being wound around the end portion with the inner barrel piece placed inside, and a seal member provided across a first region traversing the outer barrel piece in the axial direction, a second region traversing an inner surface of the barrel portion in the intersecting direction at a position closer to the terminal portion than the aluminum core wire, and a third region traversing the inner surface in the intersecting direction so as to intersect a covered portion of the end portion, and the seal member is configured to, after crimping, seal a space between the inner barrel piece and the outer barrel piece, an opening of the barrel portion formed cylindrical on the terminal portion side, and a space between the covered portion and the barrel portion, wherein a plurality of recesses is dispersedly provided on the inner surface of the barrel portion across the first region, the second region, and the third region so as to partly overlap with the seal member, the seal member includes a first seal portion, a second seal portion, and a third seal portion provided in the first region, the second region, and the third region, respectively, the second seal portion or the third seal portion being a body that is completely separated from the first seal portion with a space between the body and the first seal portion, and the barrel portion includes a projection formed on the bottom plate portion between the first region, the second region, and the third region, at least one of the plurality of recesses being provided on the projection.

* * * * *